US011774212B2

(12) United States Patent
Noonan et al.

(10) Patent No.: US 11,774,212 B2
(45) Date of Patent: Oct. 3, 2023

(54) HANDGUN

(71) Applicant: Wilson's Gun Shop, Inc, Berryville, AR (US)

(72) Inventors: Paul T. Noonan, Boise, ID (US); Brent David Boyer, Fayetteville, AR (US); Aaron Neal Trout, Fayetteville, AR (US)

(73) Assignee: Wilson's Gun Shop, Inc, Berryville, AR (US)

( * ) Notice: Subject to any disclaimer, the term of this patent is extended or adjusted under 35 U.S.C. 154(b) by 0 days.

(21) Appl. No.: 17/182,973

(22) Filed: Feb. 23, 2021

(65) Prior Publication Data

US 2022/0268551 A1 Aug. 25, 2022
US 2023/0251058 A9 Aug. 10, 2023

Related U.S. Application Data

(63) Continuation of application No. 15/921,428, filed on Mar. 14, 2018, now Pat. No. 10,962,313.

(60) Provisional application No. 62/473,061, filed on Mar. 17, 2017.

(51) Int. Cl.

| | |
|---|---|
| ***F41A 9/00*** | (2006.01) |
| ***F41C 23/10*** | (2006.01) |
| ***F41A 19/10*** | (2006.01) |
| ***F41A 17/74*** | (2006.01) |

(52) U.S. Cl.
CPC ..... *F41C 23/10* (2013.01); *F41A 17/74* (2013.01); *F41A 19/10* (2013.01)

(58) Field of Classification Search
CPC .. F41A 3/66; F41A 19/10; F41A 19/12; F41A 19/14; F41A 15/00
USPC ..... 42/6, 7, 106, 69.01, 111
See application file for complete search history.

(56) References Cited

U.S. PATENT DOCUMENTS

| | | | | |
|---|---|---|---|---|
| 4,862,618 | A * | 9/1989 | Szabo | F41A 9/69 42/7 |
| 5,533,291 | A * | 7/1996 | Boland | F41A 9/71 42/7 |
| 7,010,878 | B1 * | 3/2006 | du Plessis | F41A 19/10 42/69.01 |
| 7,373,751 | B1 * | 5/2008 | Schaffer | F41A 9/59 42/50 |
| 10,962,313 | B2 * | 3/2021 | Noonan | F41C 23/20 |
| 2011/0306020 | A1 * | 12/2011 | Peterson | F41A 33/06 434/18 |
| 2011/0314718 | A1 * | 12/2011 | Settles | B23K 20/08 42/106 |
| 2012/0017481 | A1 * | 1/2012 | Settles | F41A 17/00 42/25 |
| 2014/0338522 | A1 * | 11/2014 | Bellione | F41A 17/20 89/139 |
| 2018/0266778 | A1 * | 9/2018 | Noonan | F41A 19/10 |

* cited by examiner

*Primary Examiner* — Michael D David

(57) ABSTRACT

An improved M1911 handgun is disclosed. The improved M1911 handgun contains a handle containing a lower end, and a magazine well formed in the handle and adapted to receive and hold a double stacked magazine, wherein the inner cross-sectional profile of the magazine well is same from the lower end of the handle to a top of a frame of the improved M1911 handgun.

10 Claims, 44 Drawing Sheets

HANDGUN

CROSS REFERENCE TO RELATED APPLICATIONS

This application claims the benefit of U.S. Provisional Application No. 62/473,061, filed on Mar. 17, 2017, which is incorporated herein by reference in its entirety. This application is a continuation of U.S. patent application Ser. No. 15/921,428 titled "Handgun" filed Mar. 14, 2018, now issued U.S. Pat. No. 10,962,313, which is incorporated herein by reference in its entirety.

FIELD

The present invention relates to improvements in a handgun.

BACKGROUND

M1911 series semi-automatic pistol was invented by John Browning and, for many years, was the standard-issue sidearm for the United States Armed Forces.

Since its inception, the basic Browning M1911 design has seen very little change throughout its long production life. It is very expensive and time consuming to manufacture.

Accordingly, there is need for an improved M1911 handgun.

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements, and are not drawn to scale.

In the following description, numerous specific details are set forth to clearly describe various specific embodiments disclosed herein. One skilled in the art, however, will understand that the presently claimed invention may be practiced without all of the specific details discussed below. In other instances, well known features have not been described so as not to obscure the invention.

Figure 1A:
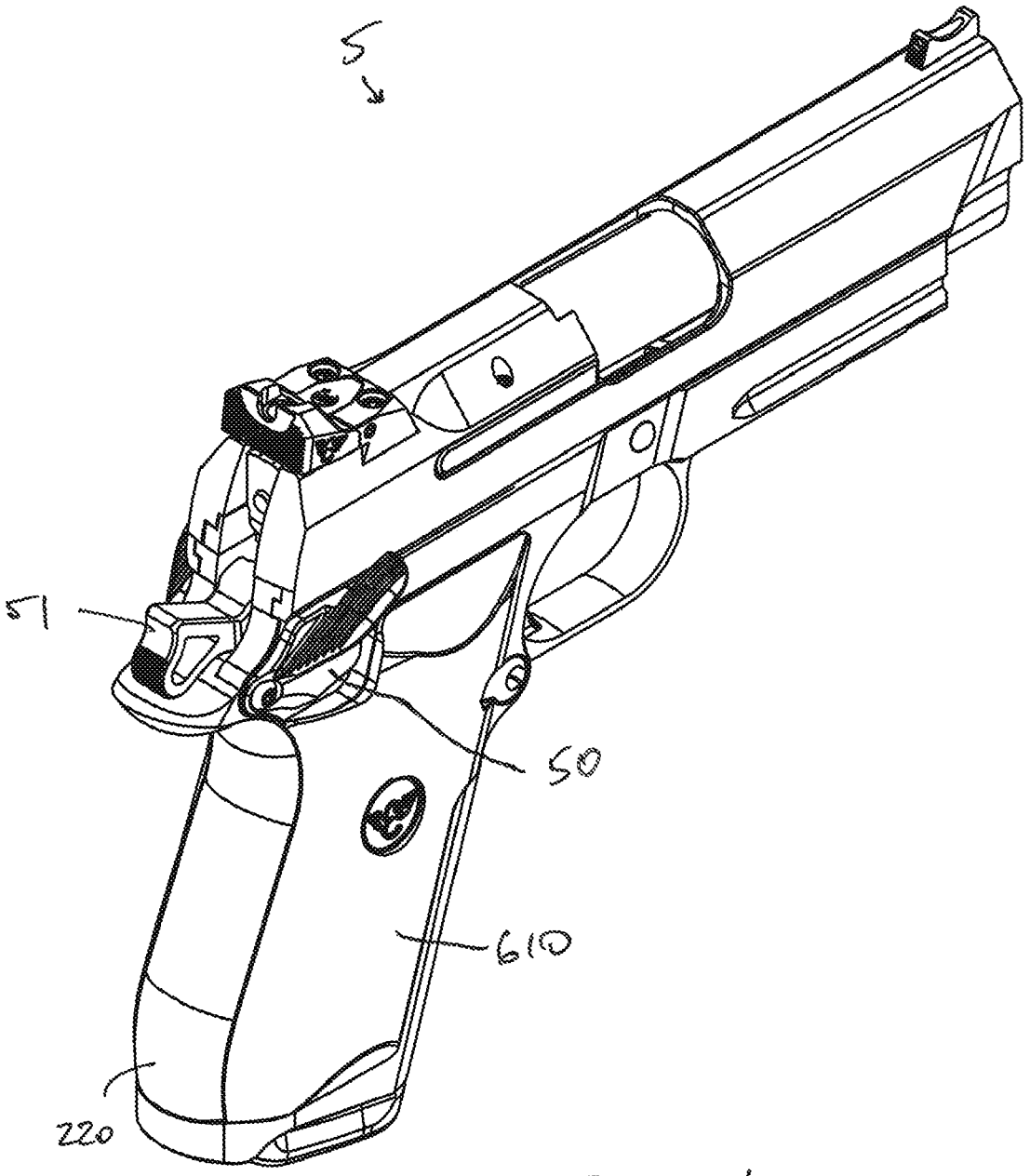
FIG. 1*a* depicts a rear view of a handgun according to some embodiments presently disclosed.
Figure 1B:
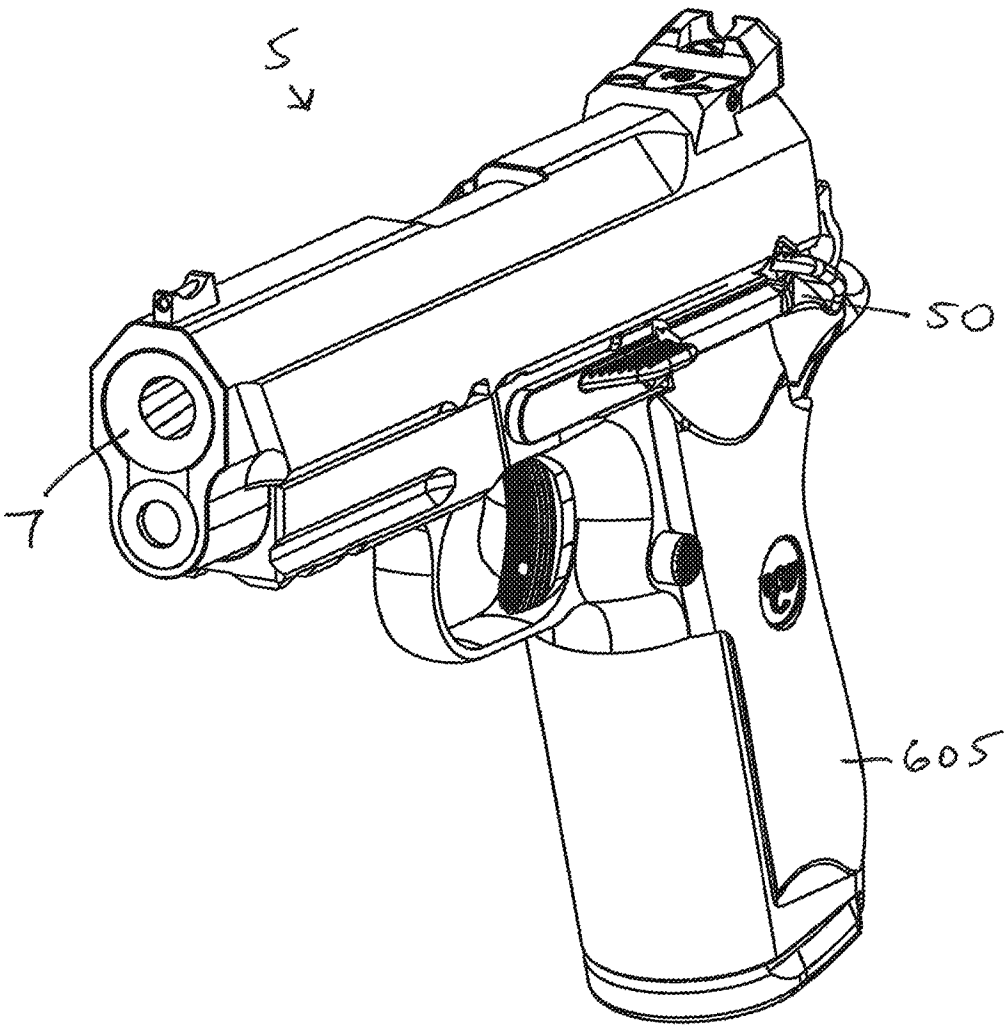
FIG. 1*b* depicts a front view of the handgun shown in FIG. 1*a*.

Referring to FIG. 1, an improved M1911 handgun 5 is shown according to some embodiments presently disclosed. Referring to FIGS. 2*a-b* and 3-4, improved M1911 handgun 5 may comprise an improved frame 10 according to the present disclosure.

Figure 5:
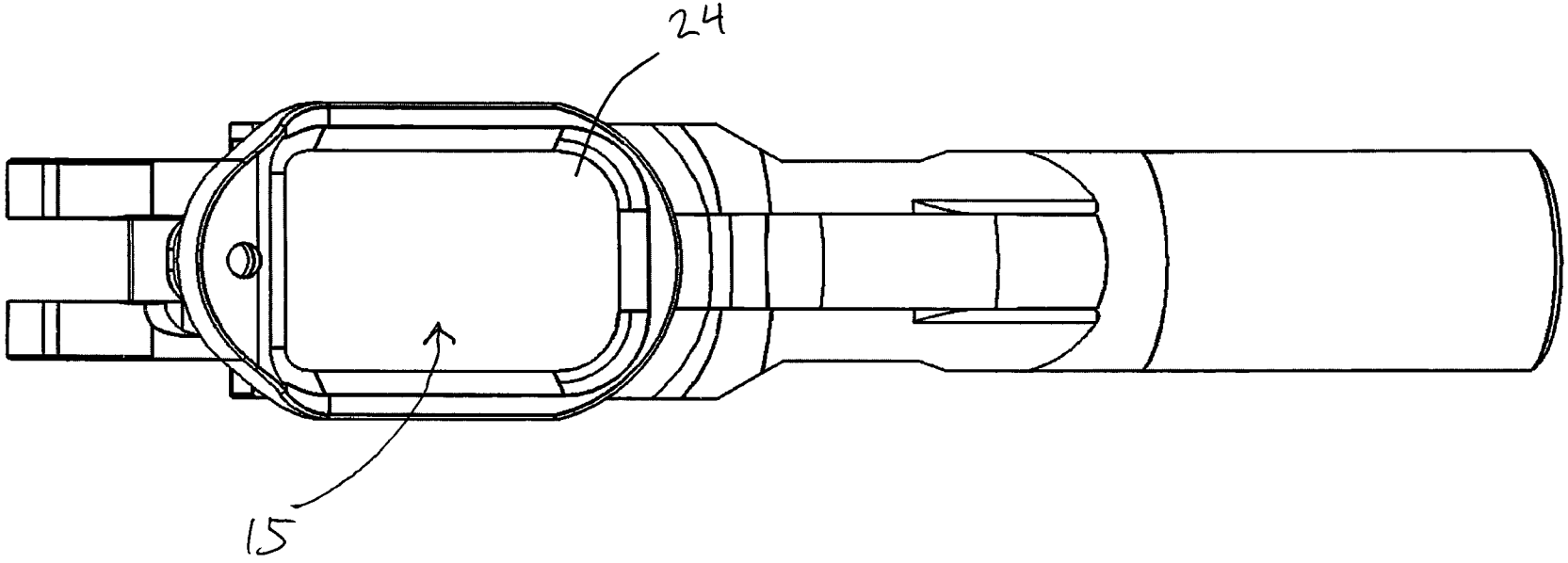
FIG. 5 depicts a bottom view of the handgun frame shown in FIG. 2*a*.
Figure 6:
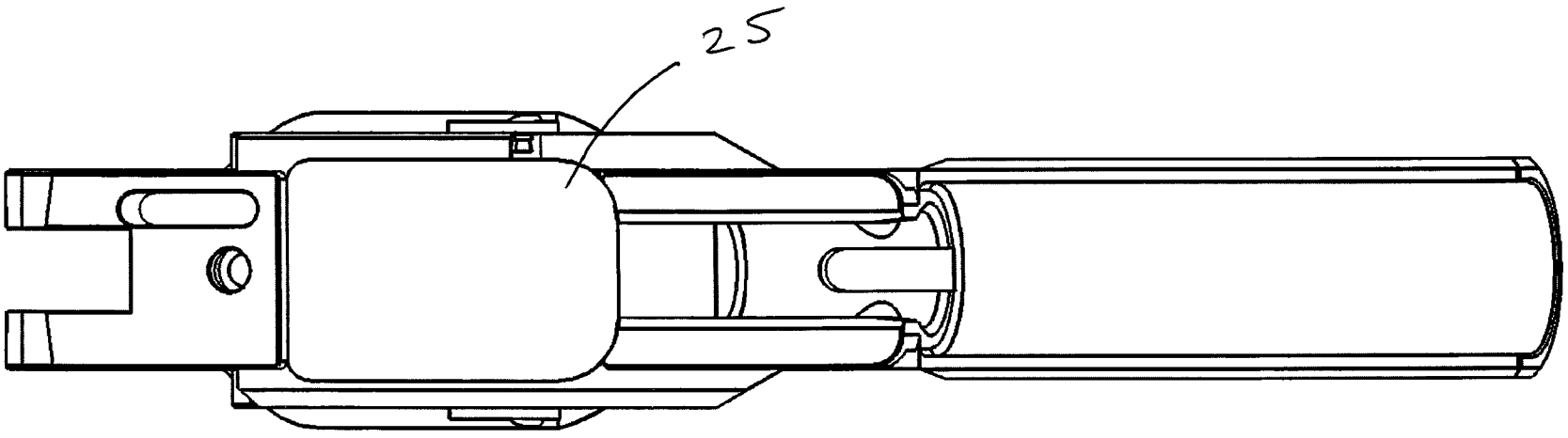
FIG. 6 depicts a top view of the handgun frame shown in FIG. 2*a*.

The improved frame 10 comprises a magazine well 15 (shown in FIG. 5) in the handle (i.e. grip) 20. The magazine well 15 is configured (i.e. adapted) to receive and hold a magazine 30 (shown in FIGS. 34-35). The magazine 30 is a double stacked magazine.

The magazine well 15 comprises a lower end 24 that is open to receive the magazine 30. The magazine well 15 further comprises an upper end 25 that is open, allowing a projectile (not shown) to be transferred from the magazine 30 to a firing assembly and fired from the handgun 5. The inner cross-sectional profile of the lower end 24 is complementary to an inner cross-sectional profile of the upper end 25.

According to some embodiments presently disclosed, the magazine well 15 is formed by machining or broaching an opening from the bottom end 21 of the handle 20 to the top 11 of the frame 10. According to some embodiments presently disclosed, the diameter of the opening for the magazine well 15 is the same (i.e. uniform) from the bottom end 21 of the handle 20 to the top 11 of the frame 10. According to some embodiments presently disclosed, the inner cross-sectional profile of the opening for the magazine well 15 is the same (i.e. uniform) from the bottom end 21 of the handle 20 to the top 11 of the frame 10.

Figure 7:
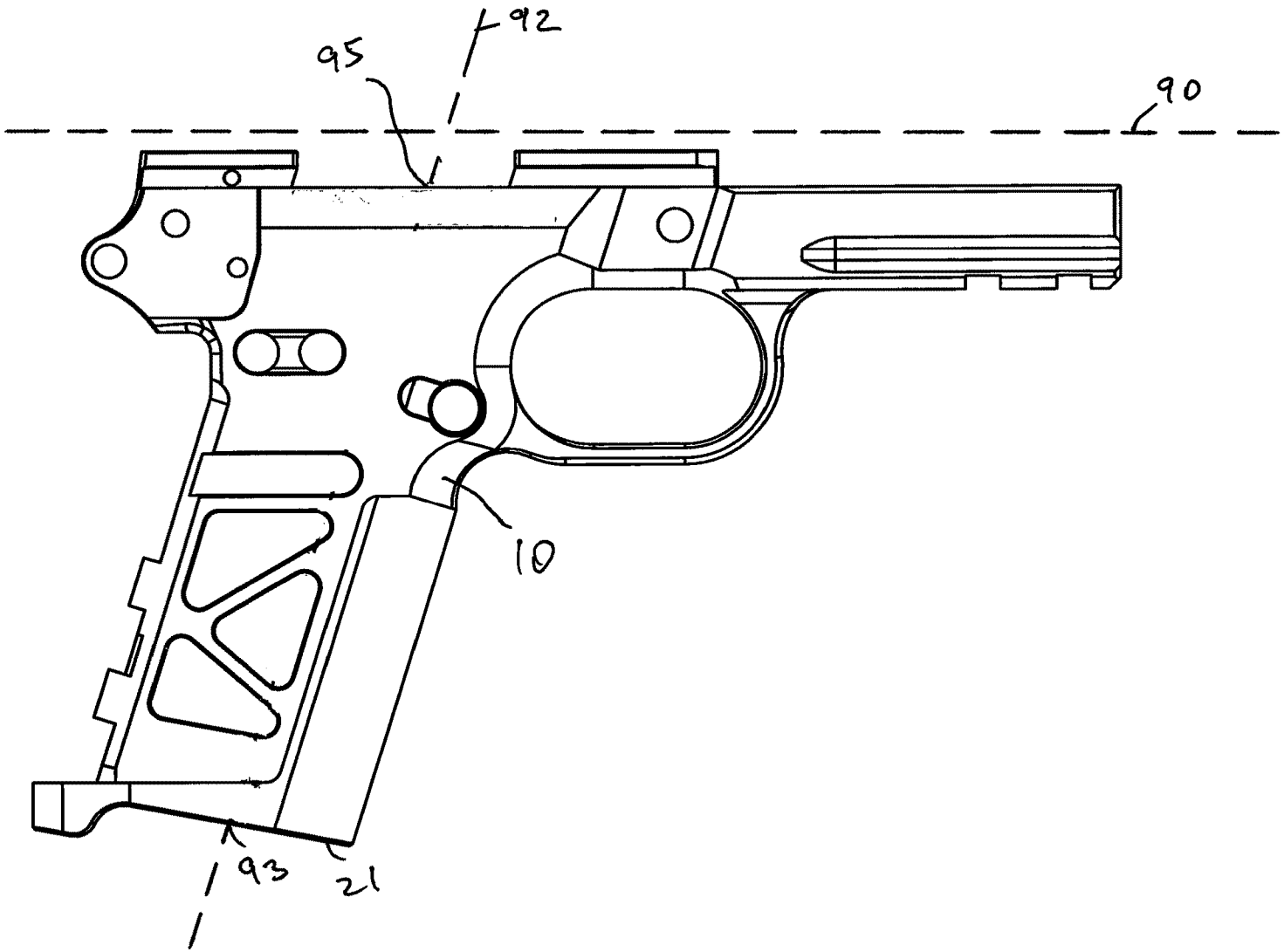
FIG. 7 depicts a right side view of the handgun frame shown in FIG. 2*a*.
Figure 38:
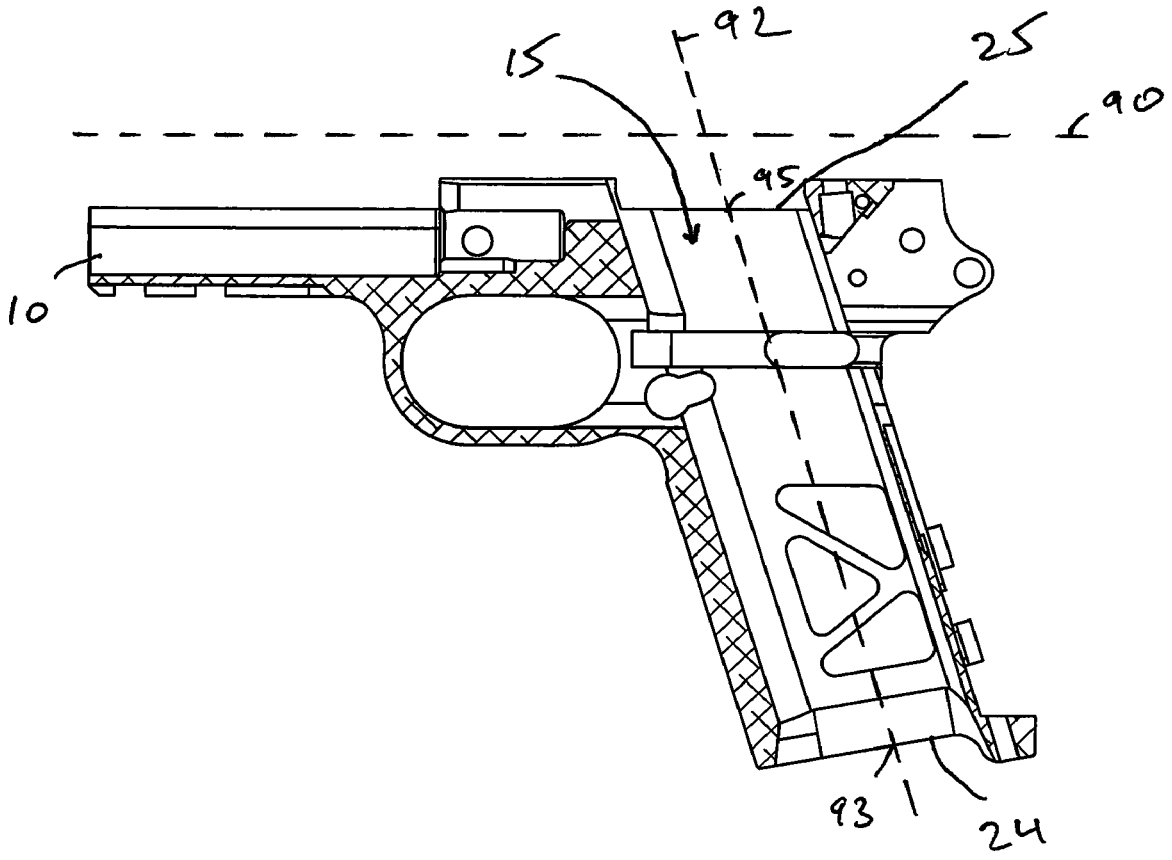
FIG. 38 depicts a side, cut away view of a handgun according to some embodiments presently disclosed.

As illustrated in FIGS. 7 and 38, the magazine well 15 can have a general major angle $\alpha$ with respect to a barrel bore axis 90 of a barrel 7. The general major angle $\alpha$ is measured at the intersection of the magazine center line 92 as measured between a centerpoint 93 from an inner cross-sectional profile at a lower end 24 and a centerpoint 95 from an inner cross-sectional profile at the upper end 25 to the bore axis 90 of the barrel 7. FIG. 38 depicts a cut away view of the frame 10 to better see the inner cross-sectional profile of the magazine well 15.

Figure 2A:
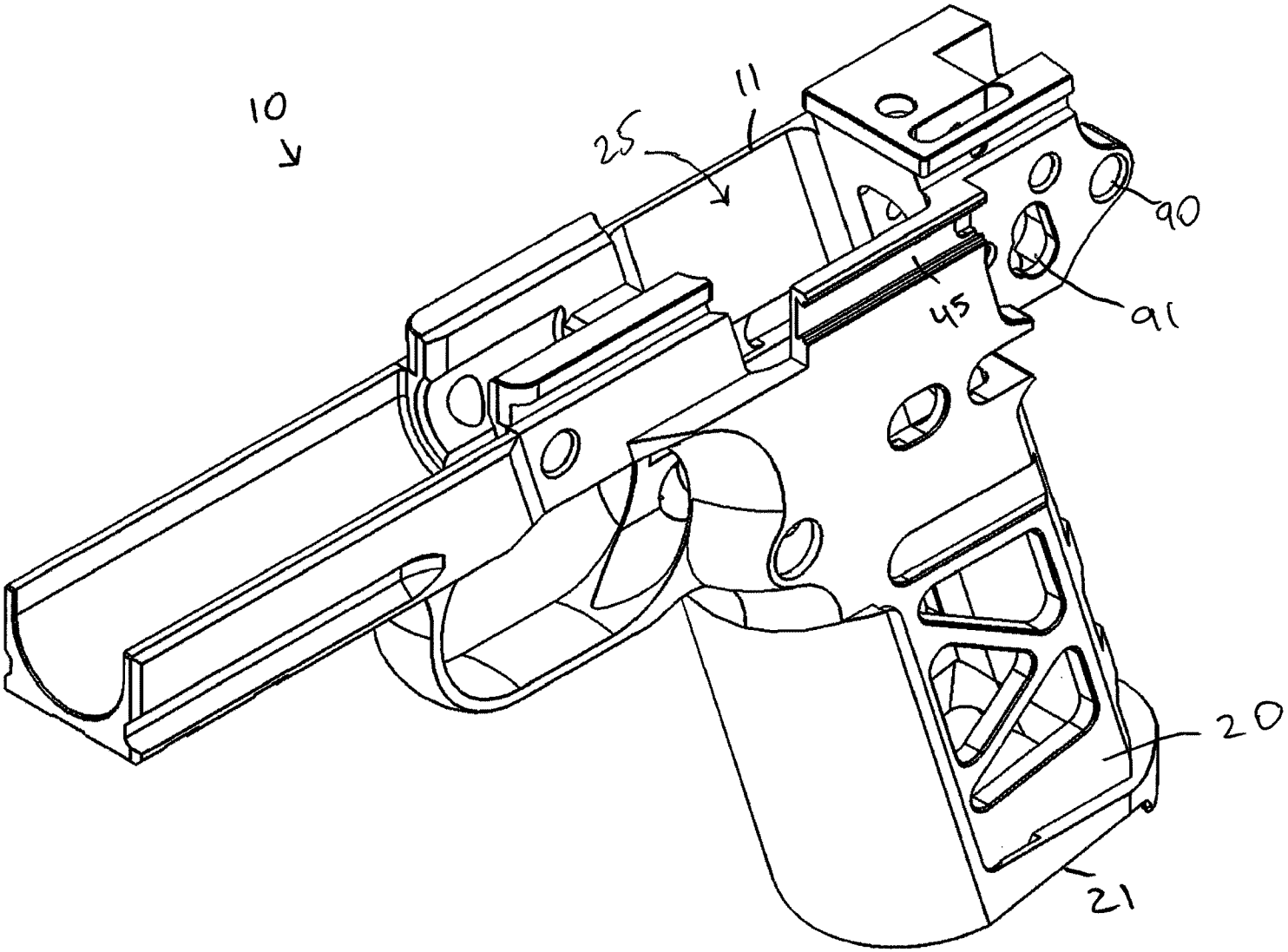
FIG. 2*a* depicts a front perspective view of a handgun frame according to some embodiments presently disclosed.
Figure 2B:
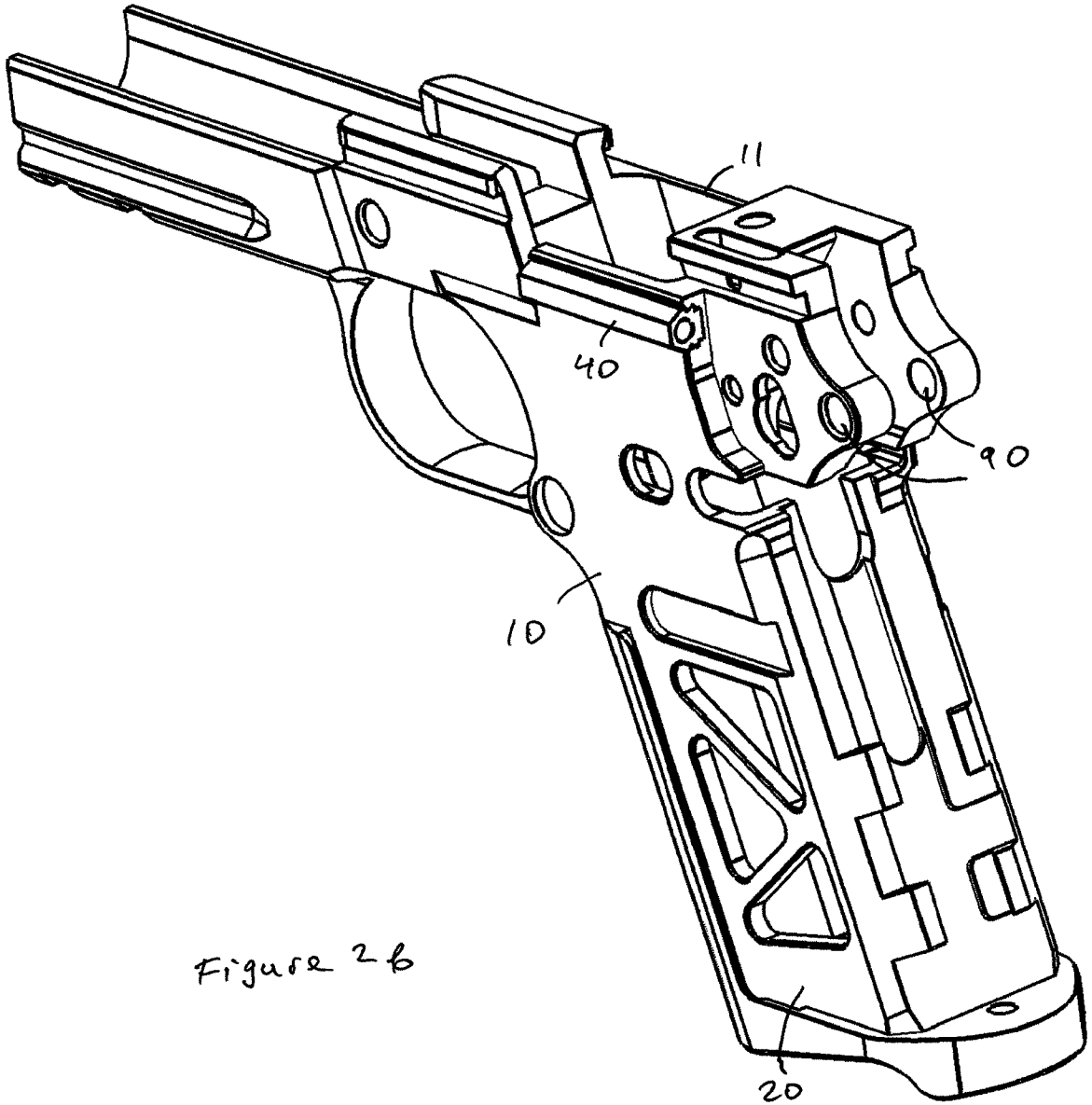
FIG. 2*b* depicts a left, rear perspective view of the handgun frame shown in FIG. 2*a*.
Figure 3:
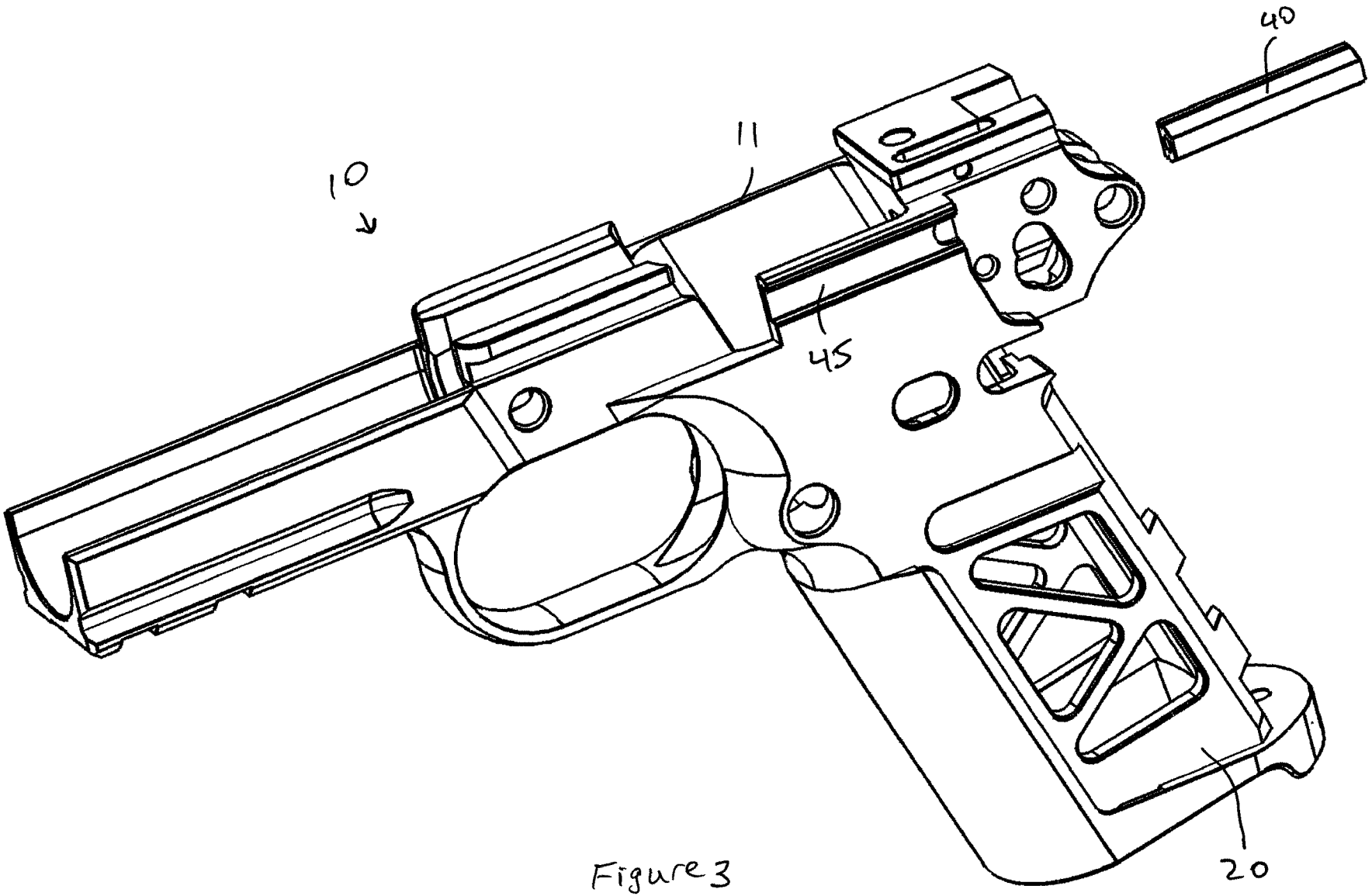
FIG. 3 depicts a side perspective view of the handgun frame shown in FIG. 2*a*.
Figure 4:
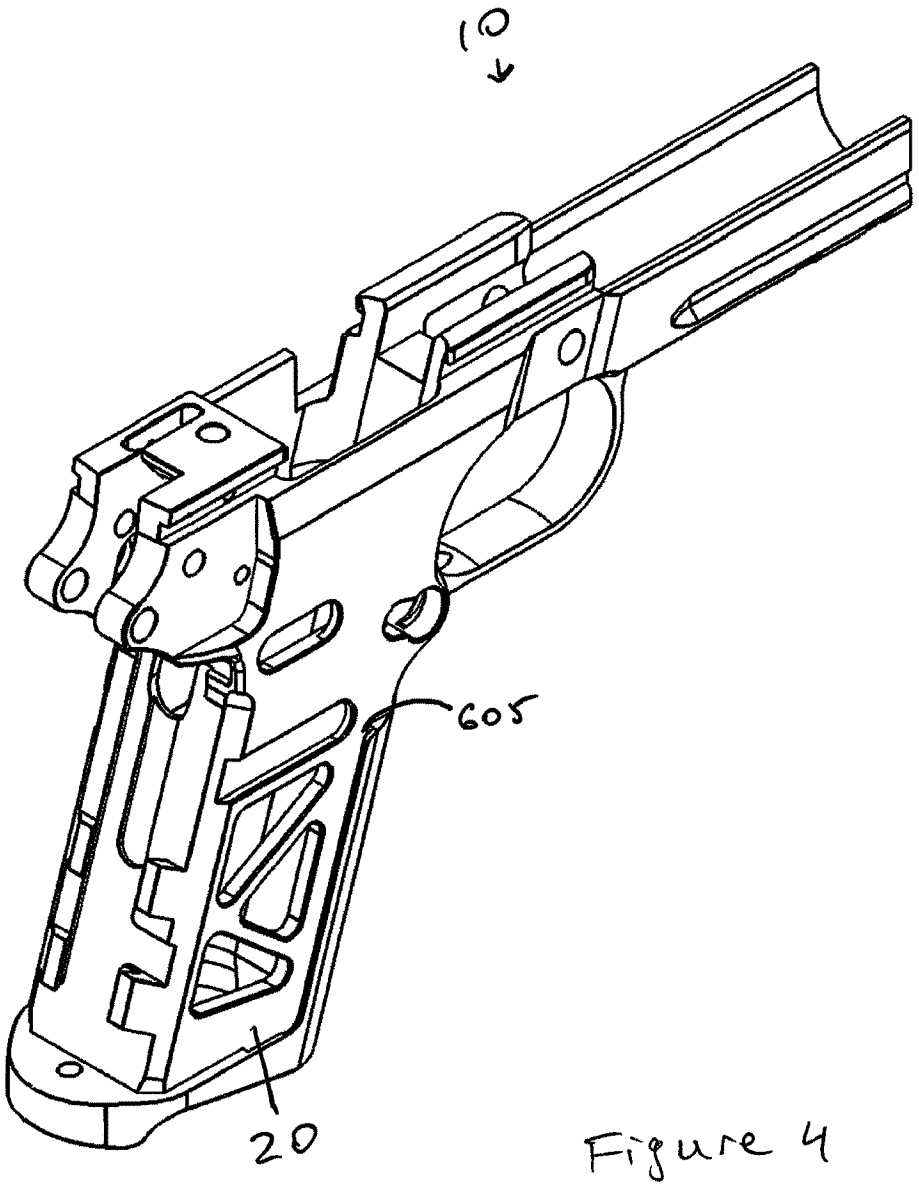
FIG. 4 depicts a right, rear perspective view of the handgun frame shown in FIG. 2*a*.
Figure 8:
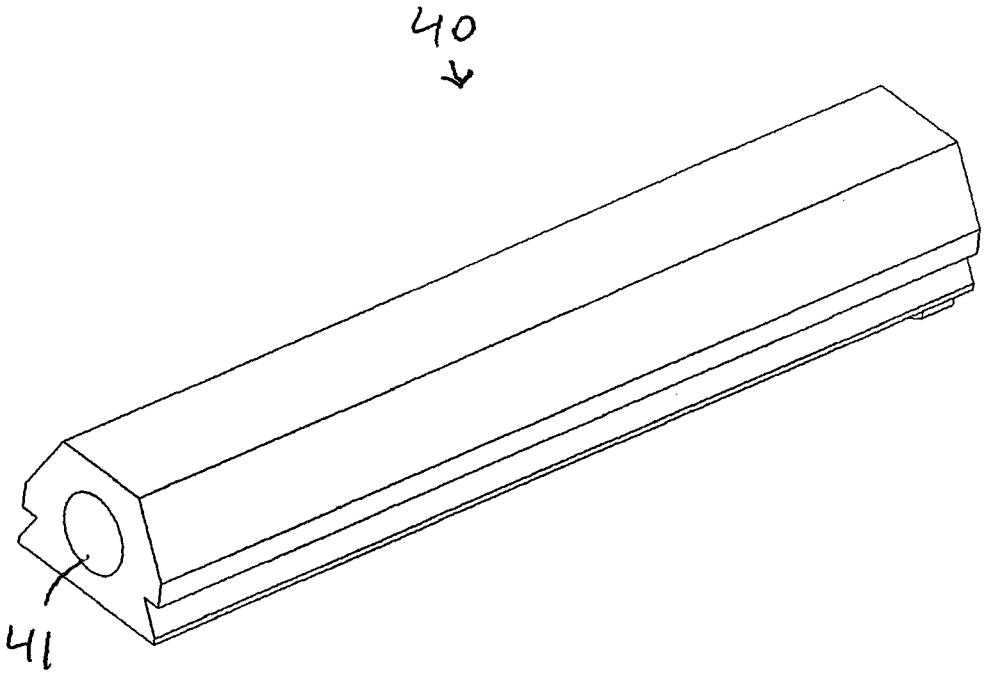
FIG. 8 depicts a perspective view of a plunger tube according to some embodiments presently disclosed.

According to some embodiments presently disclosed, the improved M1911 handgun 5 may comprise a plunger tube 40 (shown in FIGS. 2*a-b* and 3). According to some embodiments, the plunger tube 40 is removably coupled with the frame 10 (shown in FIGS. 2*a* and 3). According to some embodiments, the plunger tube 40 is slidably coupled with the frame 10 (shown in FIGS. 2*a* and 3). According to some embodiments, the frame 10 comprises an opening 45 adapted to receive and hold the plunger tube 40. The opening 45 may be a dovetail opening configured to accommodate a corresponding dovetail shape of the plunger tube 40 as shown in FIG. 8.

Contrary to the prior art, the presently disclosed plunger tube 40 is positioned further away from the magazine center line 92 to maintain the same cross-sectional profile along the entire length of the magazine well 15.

According to some embodiments presently disclosed, the improved M1911 handgun 5 may comprise a thumb safety assembly 50 (shown in FIGS. 9*a-c*) for blocking or otherwise preventing operation of a hammer 51 in the firearm 5. According to some embodiments presently disclosed, the thumb safety assembly 50 comprises a first main body 55, an engagement member 60 and a pivot member 65.

The first main body 55 comprises an inner side surface 70 (shown in FIGS. 9*a-c*) configured to engage and ride over or along the frame 10 (shown in FIG. 1*b*) of the handgun 5. The first main body 55 further comprises an outer side surface 75 (shown in FIG. 9*c*) that is opposite the inner side surface 70.

The pivot member 65 comprises a first end 80 and a second end 85. According to some embodiments presently disclosed, the first end 80 extends from the inner side surface 70 of the first main body 55.

According to some embodiments presently disclosed, the frame 10 comprises an opening 90 (shown in FIG. 2*a*) configured to accommodate the second end 85 of the pivot member 65. Once inserted in to the opening 90 of the frame 10, the first main body 55 is configured to move from a first (fire) position to a second (safe) position and back to the first (fire) position. Once inserted in to the opening 90 of the frame 10, the first main body 55 is configured to pivot from a first (fire) position to a second (safe) position and back to the first (fire) position. Once inserted in to the opening 90 of the frame 10, the first main body 55 is configured to pivot about the pivot member 65 from a first (fire) position to a second (safe) position and back to the first (fire) position. When the first main body 55 is in the first (fire) position, the hammer 51 is not blocked and the handgun 5 is able to fire ammunition. When the first main body 55 is in the second (safe) position, the hammer 51 is blocked or otherwise prevented from operating and the handgun 5 is unable to fire ammunition.

According to some embodiments presently disclosed, the engagement member 60 extends from the inner side surface 70 of first main body 55. According to some embodiments presently disclosed, the frame 10 comprises an opening 91 configured to accommodate the engagement member 60 when the pivot member 65 is inserted into the opening 90. According to some embodiments presently disclosed, the engagement member 60 comprises a series of angled engagement features or surfaces 92-93 configured to engage internal features of the handgun 5 to block or otherwise prevent operation of the hammer 51 when the first main body 55 is in the second (safe) position.

According to some embodiments presently disclosed, a tab member 56 extends from the outer side surface 75 of first main body 55. The tab member 56 is configured to allow a user' thumb to move the first main body 55 from the first (fire) position to the second (safe) position and back to the first (fire) position. The tab member 56 may comprise surface features 57 formed therealong to facilitate better gripping and engagement by the user's thumb.

Figure 10:
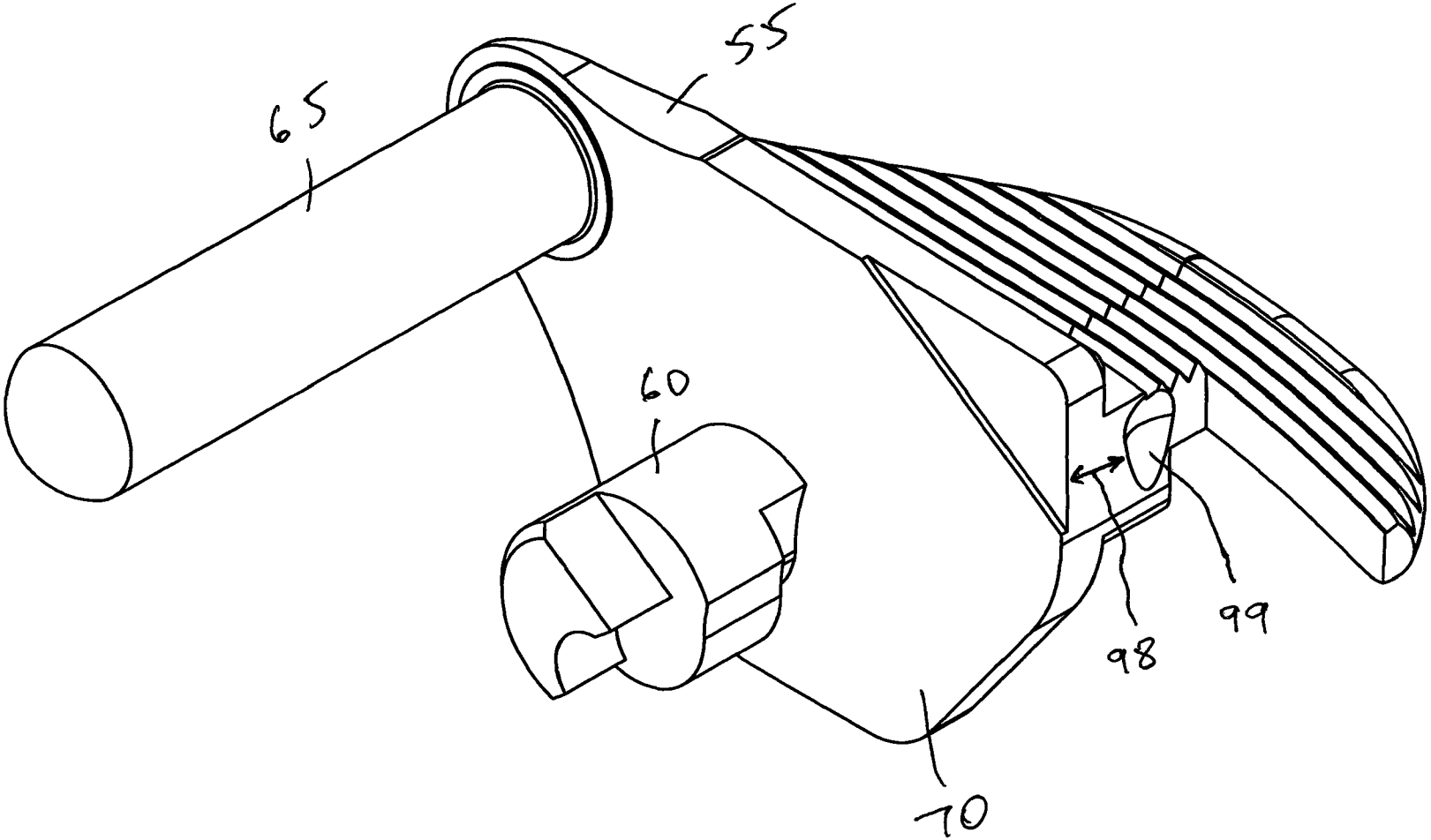
FIG. 10 depicts a perspective view of another safety assembly according to some embodiments presently disclosed.

According to some embodiments presently disclosed, the thumb safety assembly 50 may further comprise a second main body 155 to allow ambidextrous operation of the thumb safety assembly 50. According to some embodiments presently disclosed, the second main body 155 comprises a through opening 130 shown in FIG. 10.

The second main body 155 comprises an inner side surface 145 (shown in FIG. 9*c*) configured to engage and ride over or along the frame 10. The second main body 155 further comprises an outer side surface 150 (shown in FIGS. 9*a-c*) that is opposite the inner side surface 145. According to some embodiments presently disclosed, a protrusion 151 extends from the inner surface 145 of the second main body.

According to some embodiments presently disclosed, the second end 65 of the pivot member 55 comprises an opening 170 (shown in FIG. 9*b*) configured to accommodate a fastener 175 and a portion of the protrusion 151.

Figure 9A:
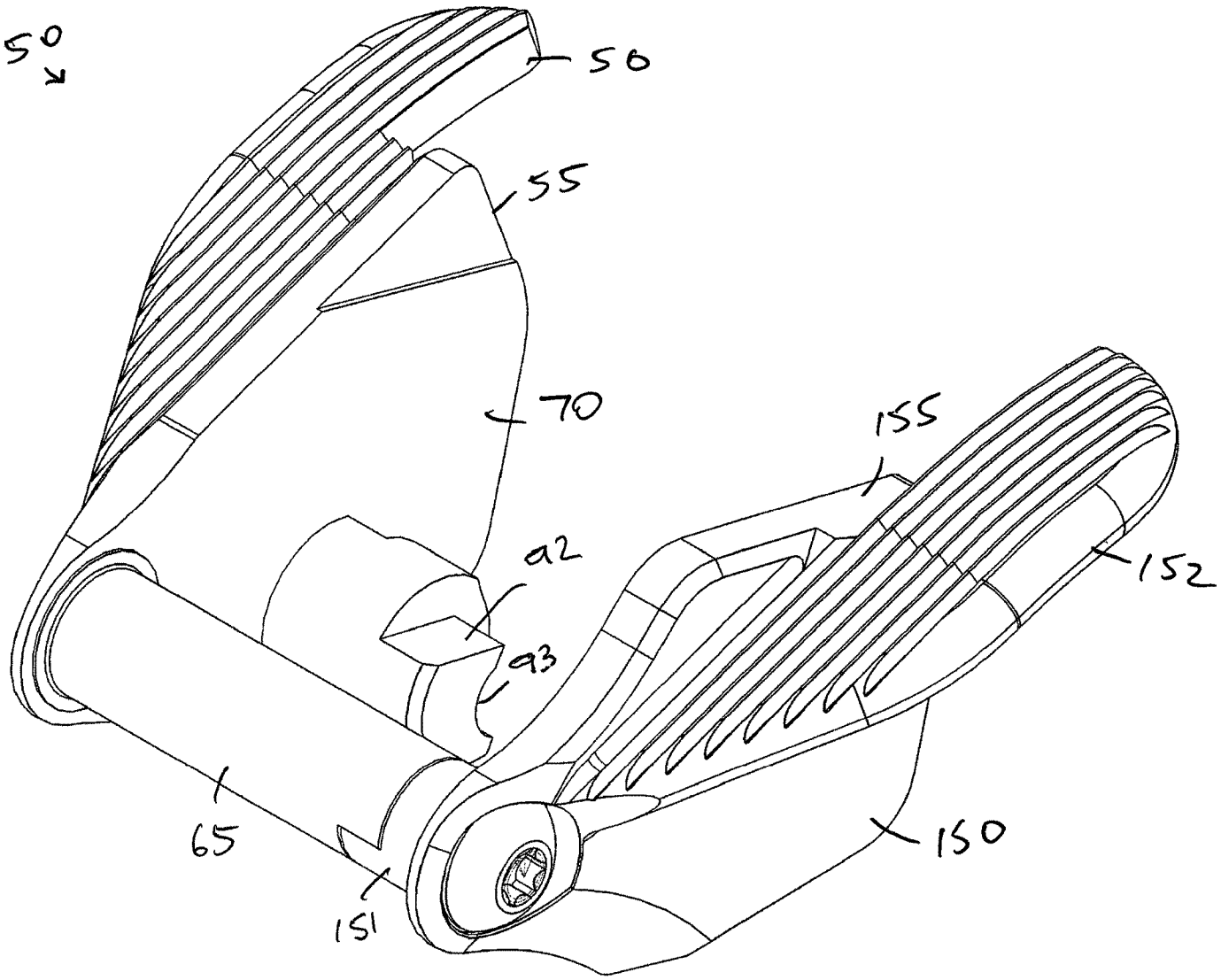
FIG. 9*a* depicts a perspective view of a safety assembly according to some embodiments presently disclosed.
Figure 9B:
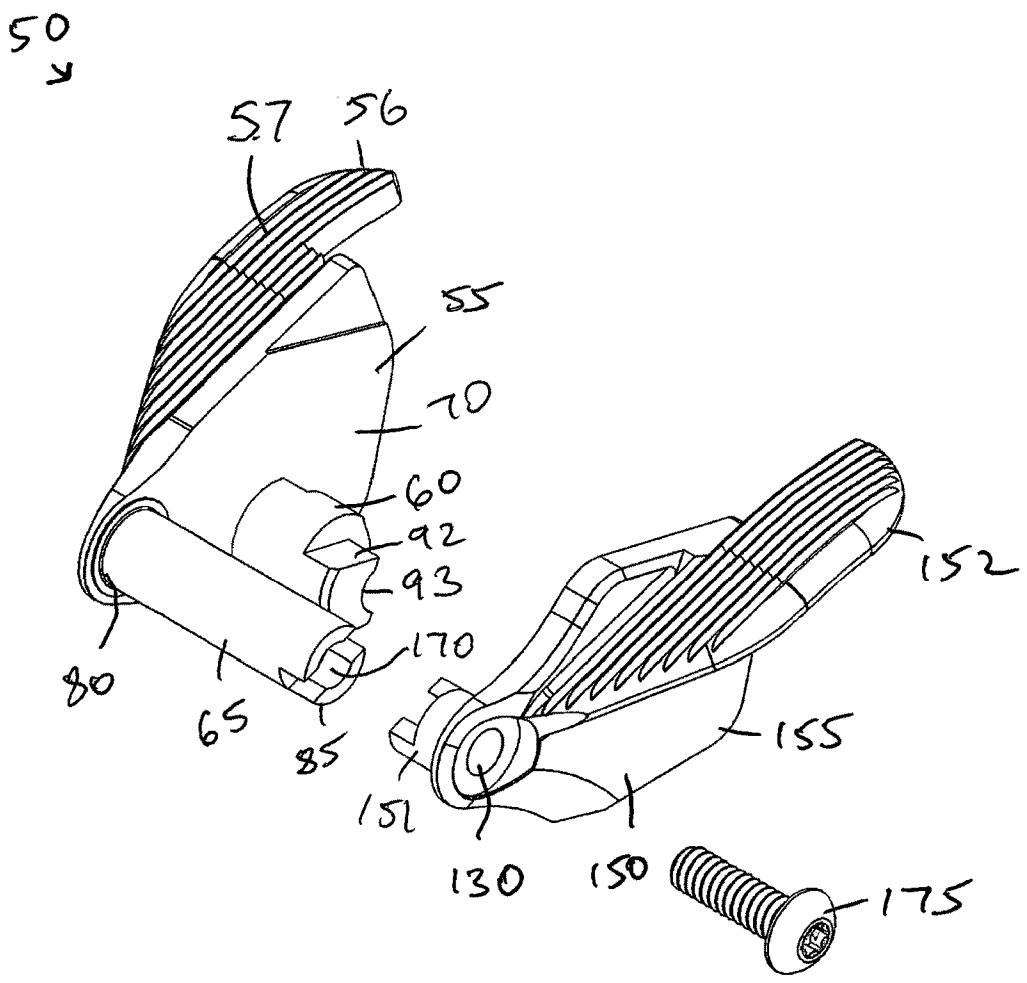
FIG. 9*b* depicts an exploded view of the safety assembly shown in FIG. 9*a*.
Figure 9C:
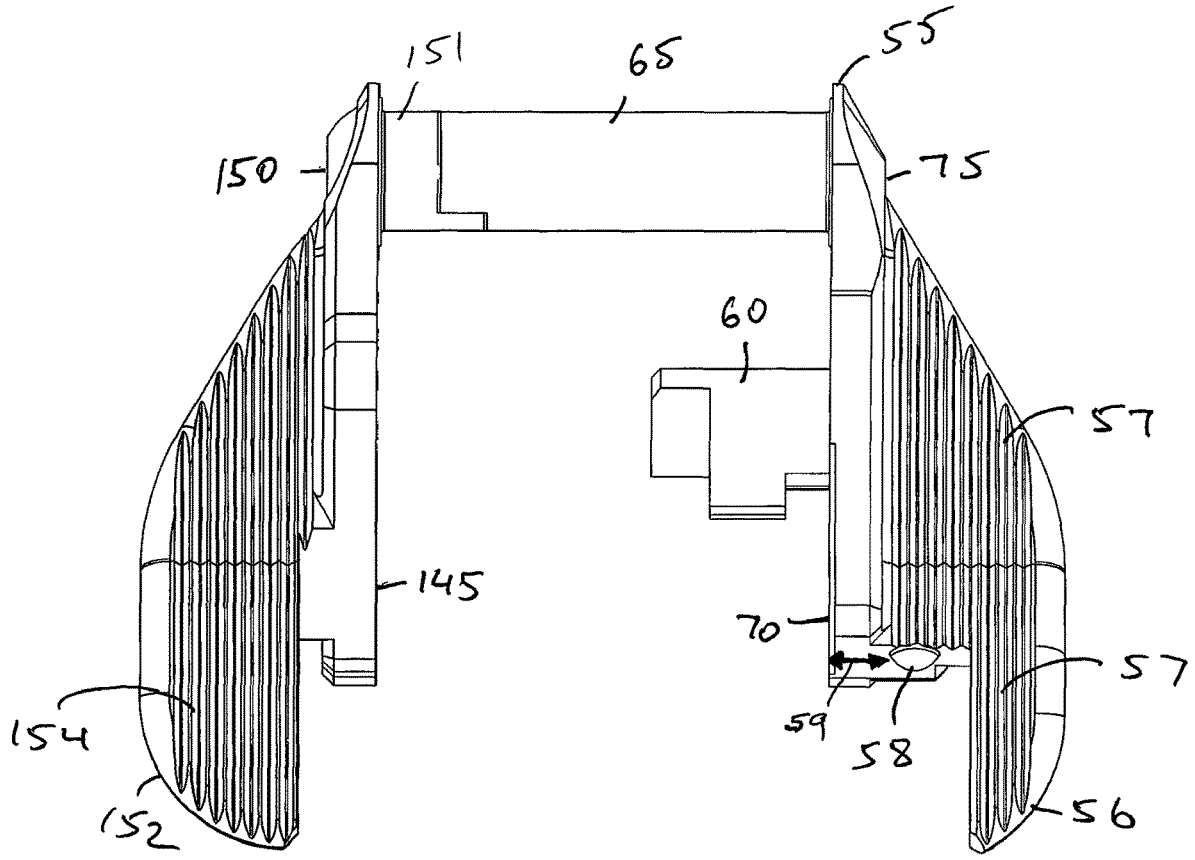
FIG. 9*c* depicts a top view of the safety assembly shown in FIG. 9*a*.

According to some embodiments presently disclosed, the protrusion 151 is coupled with the second end 85 of the pivot member 65 (shown in FIGS. 9*a* and 9*c*) using, for example, the fastener 175 (shown in FIGS. 9*a-b*). The fastener 175 may be a pin, a screw, a setscrew, a full dog point set screw, or a dogleg set screw. The through opening 130 and the opening 170 are configured to accommodate the fastener 175.

According to some embodiments presently disclosed, the opening 90 of the frame 10 is a through opening configured to accommodate the pivot member 65 and the protrusion 151. Once inserted in to the opening 90 of the frame 10, the first main body 55 and the second main body 155 are configured to move from the first (fire) position to the second (safe) position and back to the first (fire) position. Once inserted in to the opening 90 of the frame 10, the first main body 55 and the second main body 155 are configured to pivot from the first (fire) position to the second (safe) position and back to the first (fire) position. Once inserted in to the opening 90 of the frame 10, the first main body 55 and the second main body 155 are configured to pivot about the pivot member 65 and the protrusion 151 from the first (fire) position to the second (safe) position and back to the first (fire) position. When the first main body 55 and the second main body 155 are in the first (fire) position, the hammer 51 is not blocked and the handgun 5 is able to fire ammunition. When the first main body 55 and the second main body 155 are in the second (safe) position, the hammer 51 is blocked or otherwise prevented from operating and the handgun 5 is unable to fire ammunition.

According to some embodiments presently disclosed, a tab member 152 extends from the outer side surface 150 of second main body 155. The tab member 152 is configured to allow the user' thumb to move the second main body 155 from the first (fire) position to the second (safe) position and back to the first (fire) position. The tab member 152 may comprise surface features 154 formed therealong to facilitate better gripping and engagement by the user's thumb.

According to some embodiments presently disclosed, the first main body 55 comprises a detent (i.e. rounded protrusion) 58 positioned to align with an opening 41 of the plunger tube 40. The detent 58 is positioned a first distance 59 from the inner side surface 70 of first main body 55.

Contrary to the prior art, the presently disclosed detent 58 is positioned further away from the inner side surface 70 of first main body 55 to align with an opening 41 of the plunger tube 40.

Since the presently disclosed plunger tube 40 is positioned further away from the magazine center line 92, the presently disclosed detent 58 is positioned further away from the inner side surface 70 of first main body 55 to align with an opening 41 of the plunger tube 40.

Figure 11A:
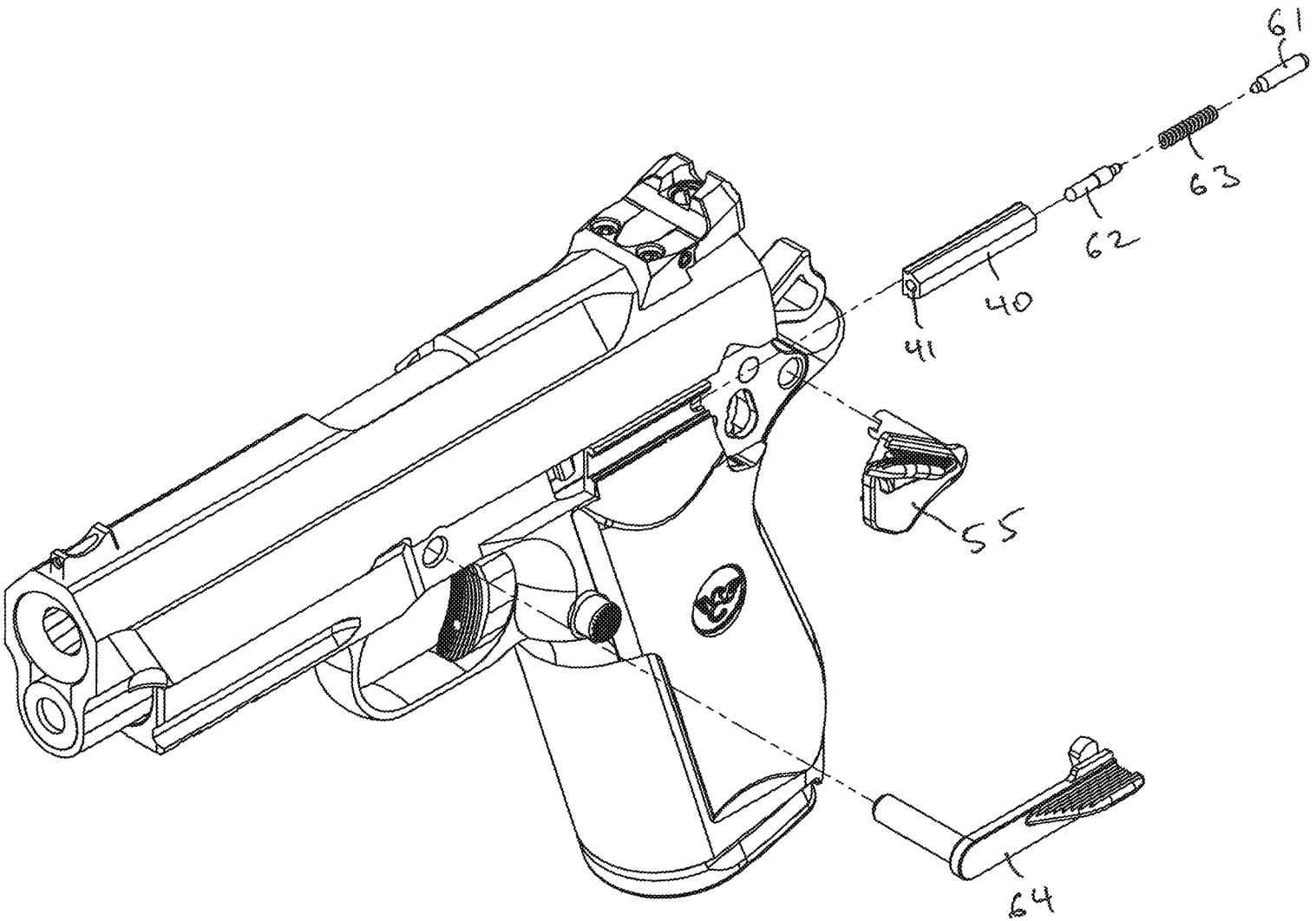
FIG. 11*a* depicts a handgun according to some embodiments presently disclosed.
Figure 11B:
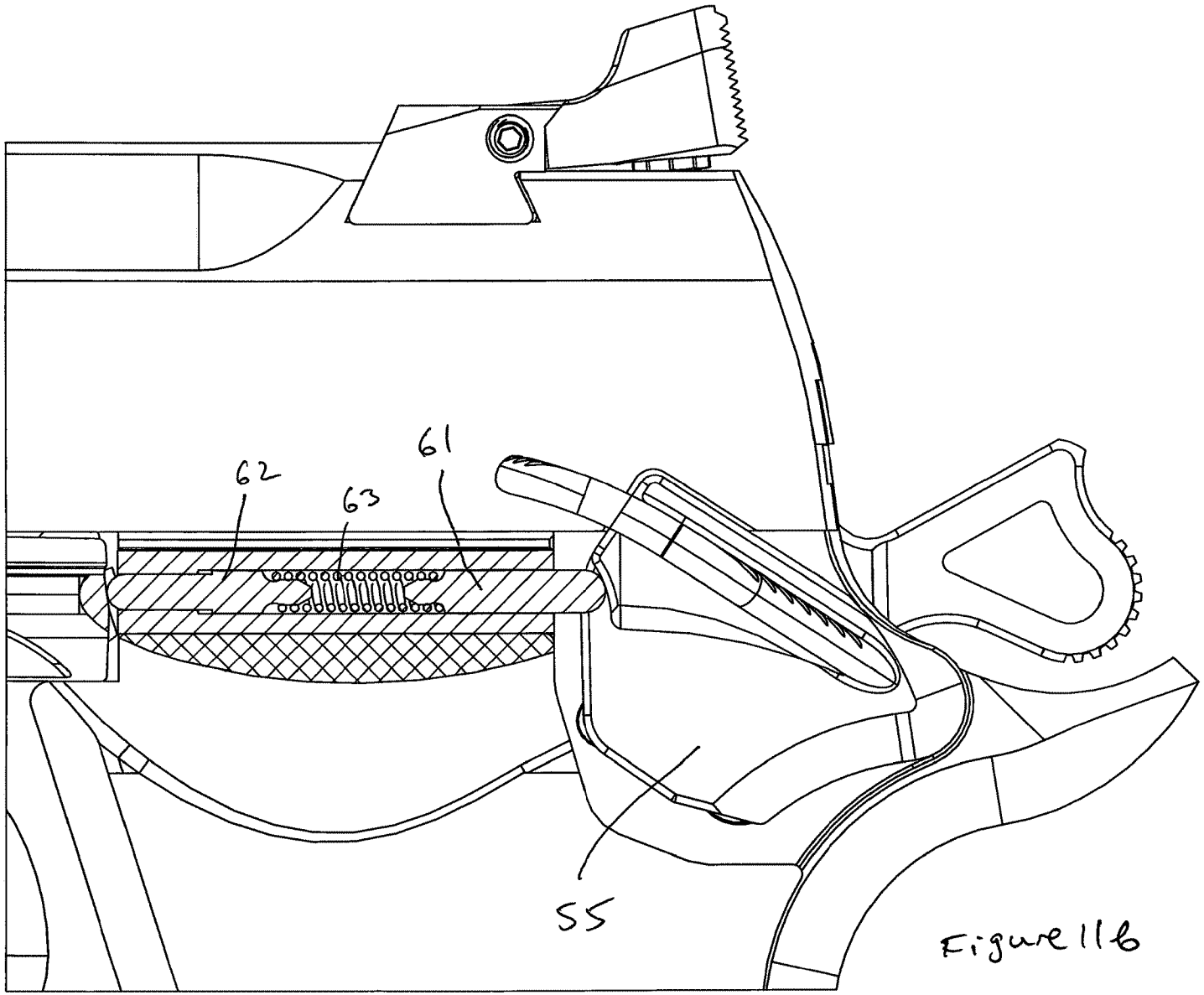
FIG. 11*b* depicts a safety assembly in a safety position according to some embodiments presently disclosed.
Figure 11C:
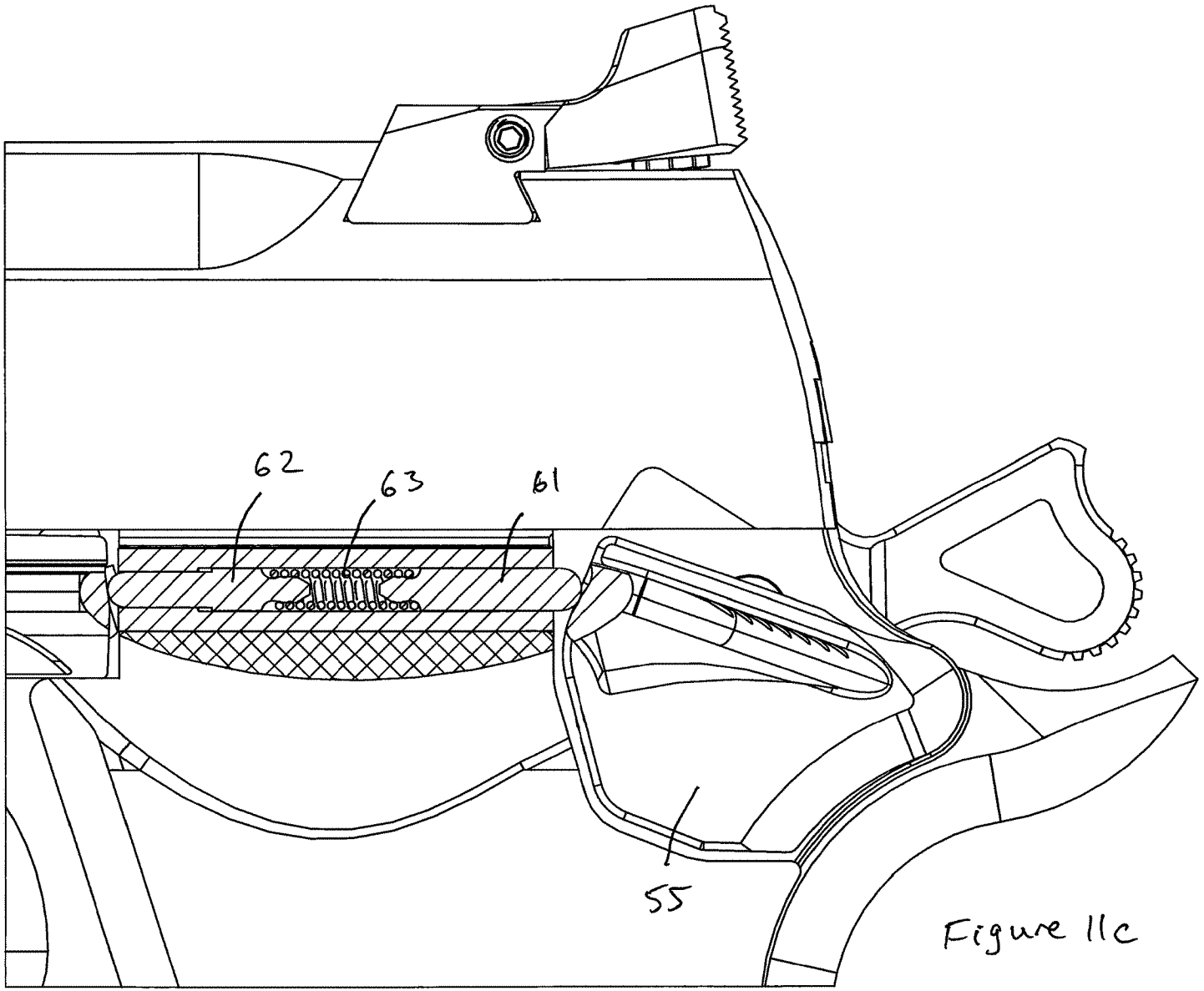
FIG. 11*c* depicts a safety assembly in a fire position according to some embodiments presently disclosed.

According to some embodiments presently disclosed, the first main body 55 comprises a cavity 99 (shown in in FIG. 10) positioned to align with a detent (protrusion) 61 (shown in FIGS. 11*a-c*) positioned in the opening 41 of the plunger tube 40. The cavity 99 is positioned a second distance 98 from the inner side surface 70 of the first main body 55.

Contrary to the prior art, the presently disclosed cavity 99 is positioned further away from the inner side surface 70 of first main body 55 to align with the detent 61 in the opening 41 of the plunger tube 40.

Since the presently disclosed plunger tube 40 is positioned further away from the magazine center line 92, the presently disclosed cavity 99 is positioned further away from the inner side surface 70 of the first main body 55 to align with the detent 61 associated with the plunger tube 40.

According to some embodiments presently disclosed, the plunger tube 40 may further comprise a spring 63 to allow the detent 61 to move in and out of the opening 41 as the first main body 55 is moved from the first (fire) position (shown in FIG. 11*c*) to the second (safe) position (shown in FIG. 11*b*) and back to the first (fire) position.

According to some embodiments presently disclosed, the plunger tube 40 may further comprise another detent 62 configured to interact with a slide stop 64. According to some embodiments presently disclosed, the opening 41 is an opening that goes through the entire length of the plunger tube 40.

Figure 12:
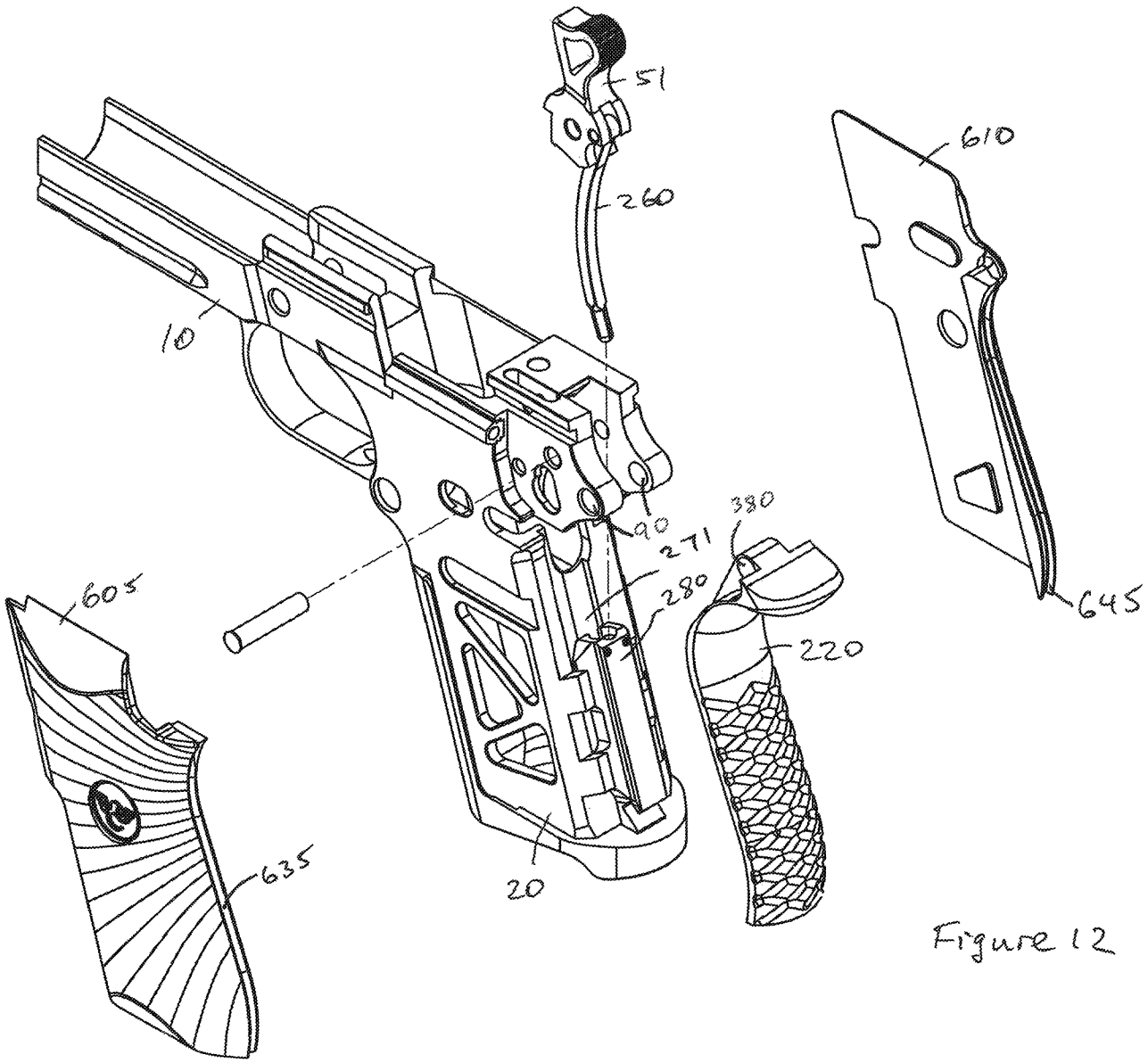
FIG. 12 depicts an exploded view of a handgun with a backstrap and side panels according to some embodiments presently disclosed.
Figure 13:
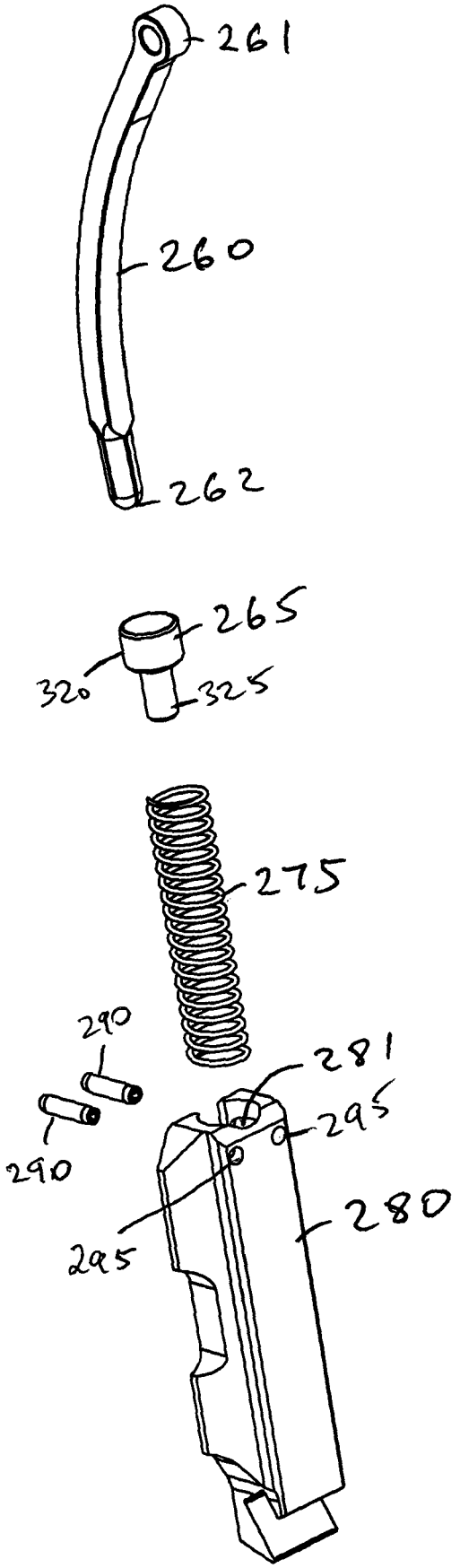
FIG. 13 depicts parts of a handgun according to some embodiments presently disclosed.

Referring to FIGS. 12-13, a portion of the handgun 5 is shown according to some embodiments presently disclosed. The handgun 5 comprises a backstrap member 220. Referring to FIG. 12, the backstrap member 220 is removably coupled with the handle 20.

According to some embodiments presently disclosed, the handgun 5 comprises the hammer 51, a strut 260, a main spring cap 265, and a main spring 275 as shown in FIG. 13. The strut 260 comprises an upper end 261 and a lower end 262. The upper end 261 of the strut 260 is associated with the hammer 51.

Figure 14:
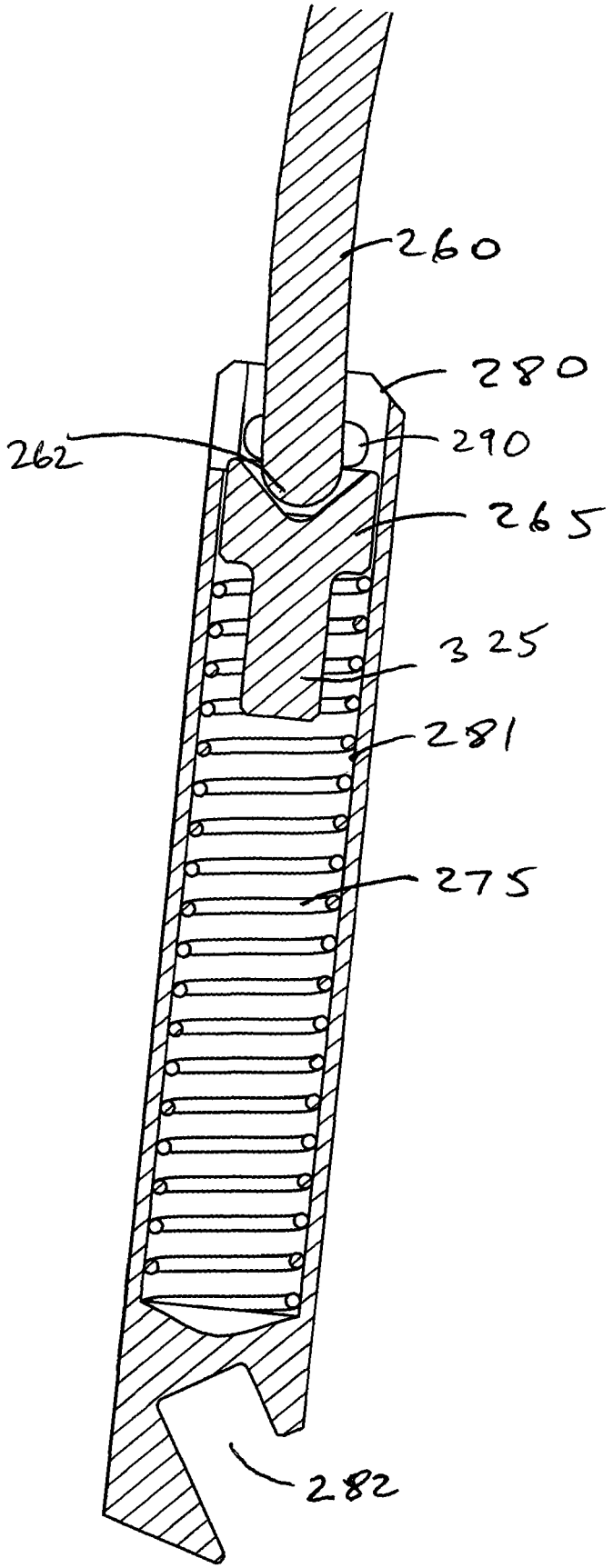
FIG. 14 depicts a cut away side view of the parts shown in FIG. 13.
Figure 15:
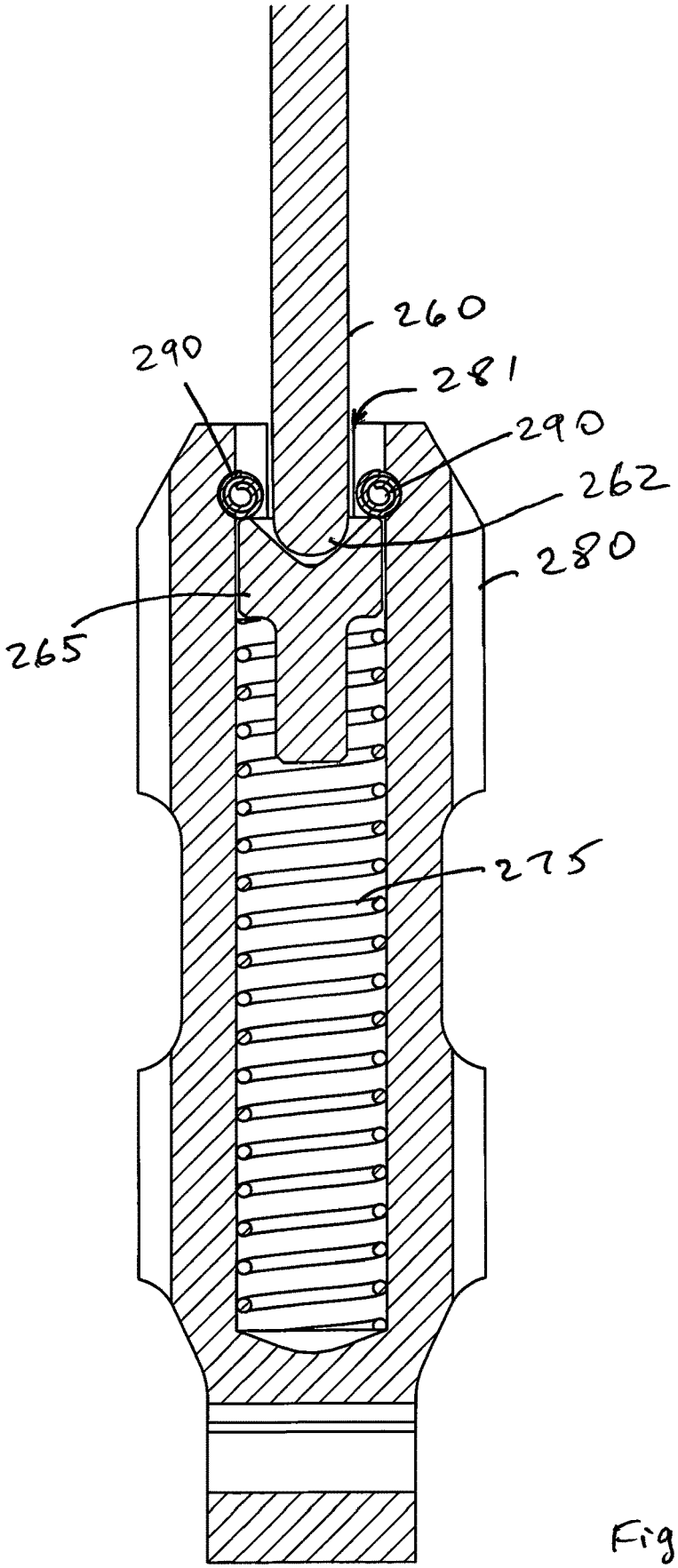
FIG. 15 depicts a cut away front view of the parts shown in FIG. 13.

According to some embodiments presently disclosed, the handle 20 comprises a cavity 271 sized to accommodate a housing 280. The housing 280 comprises a cavity 281 sized to accommodate the main spring cap 265 and the main spring 275 (shown in FIGS. 14-15 depicting a side and front cutaway views of the housing 280).

According to some embodiments presently disclosed, the main spring 275 is placed in the cavity 281 first, followed by the main spring cap 265. One or more pins 290 are inserted into one or more openings 295 to prevent the main spring cap 265, and the main spring 275 from dropping out of the cavity 281. According to some embodiments presently disclosed, the main spring cap 265 and the main spring 275 are compressed down before the one or more pins 290 are inserted into the one or more openings 295.

According to some embodiments presently disclosed, the lower end 262 of the strut 260 abuts the main spring cap 265 when the backstrap member 220 is installed on the handle 20. According to some embodiments presently disclosed, the lower end 262 of the strut 260 is positioned within the cavity 281 when the backstrap member 220 is installed on the handle 20. According to some embodiments presently disclosed, the strut 260 compresses the main spring 275 when the backstrap member 220 is installed on the handle 20 and the hammer 51 is in the lowered position.

According to some embodiments presently disclosed, the strut 260 compresses the main spring 275 a first distance from the one or more pins 290 when the backstrap member 220 is installed on the handle 20 and the hammer 51 is in the upper position. According to some embodiments presently disclosed, the strut 260 compresses the main spring 275 a second distance from the one or more pins 290 when the backstrap member 220 is installed on the handle 20 and the hammer 51 is in the lower position. The second distance is greater than the first distance.

According to some embodiments presently disclosed, the main spring cap 265 comprises a cap portion 320 and a post portion 325. The cap portion 320 is wider than the post portion 325. According to some embodiments presently disclosed, the post portion 325 is positioned within the main spring 275 and the cap portion 320 is positioned above the main spring 275 (shown in FIGS. 14-15).

According to some embodiments presently disclosed, the backstrap member 220 comprises an opening 380 configured to line up with an opening 90 on the frame 10 when the backstrap member 220 is positioned on the handle 20. According to some embodiments presently disclosed, the openings 380 and 90 are configured to accommodate the pivot member 65 of the thumb safety assembly 50.

Figure 16:
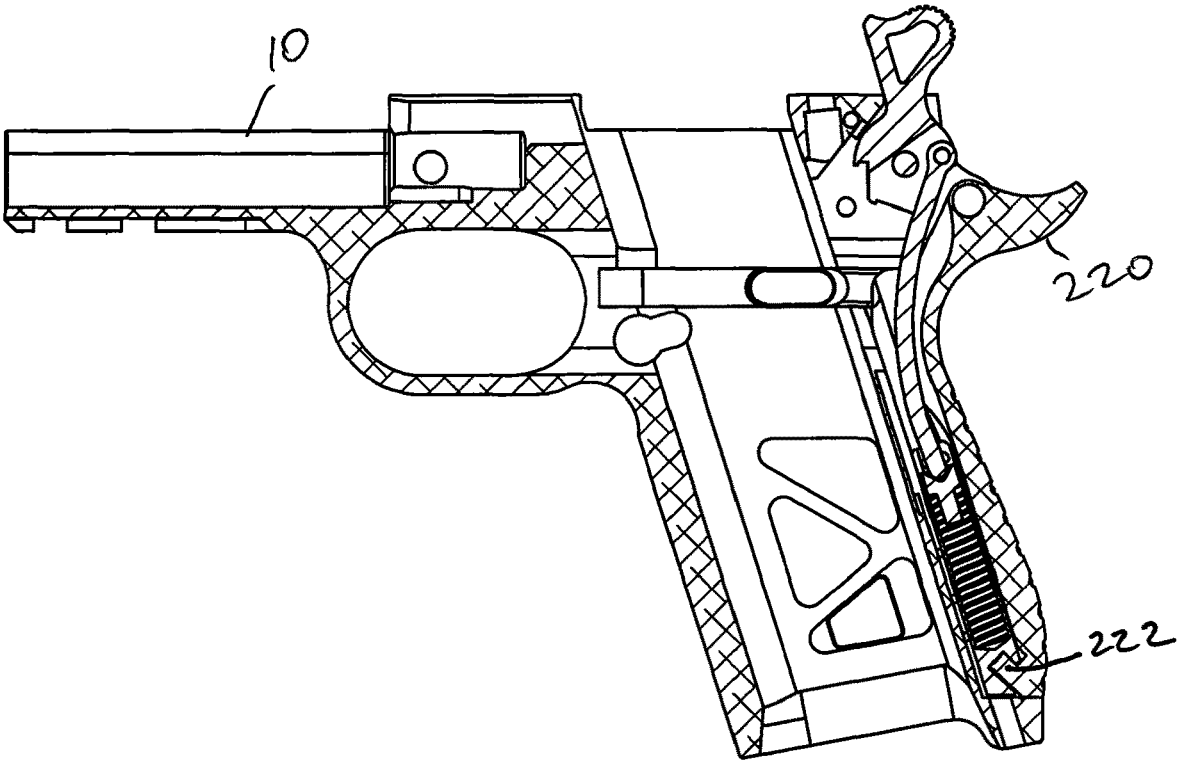
FIG. 16 depicts a cut away side view of a handgun according to some embodiments presently disclosed.
Figure 36:
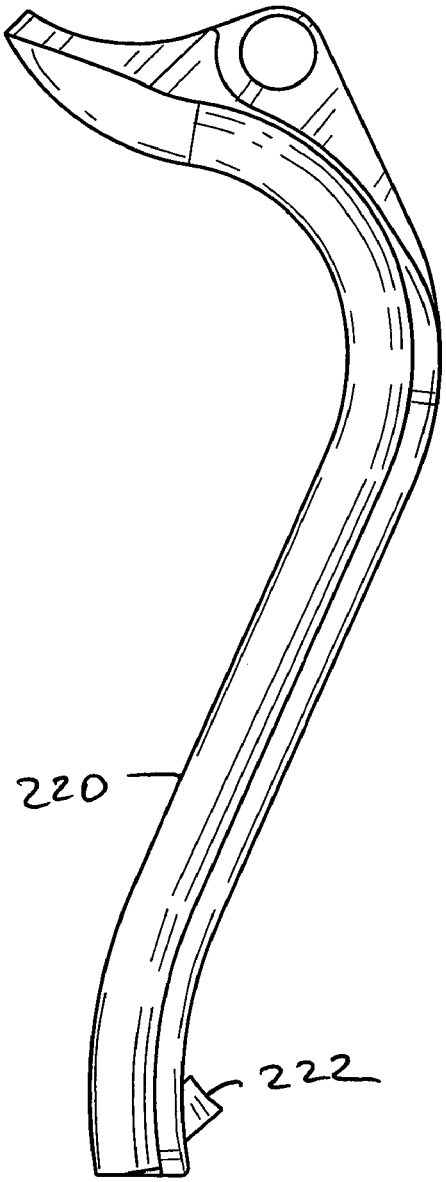
FIG. 36 depicts a side view of a backstrap according to some embodiments presently disclosed.

According to some embodiments presently disclosed, the housing 280 comprises an interlocking opening 282 configured to accommodate an interlocking protrusion 222 associated with the backstrap member 220 as shown in FIGS. 16 and 36.

Figure 18:
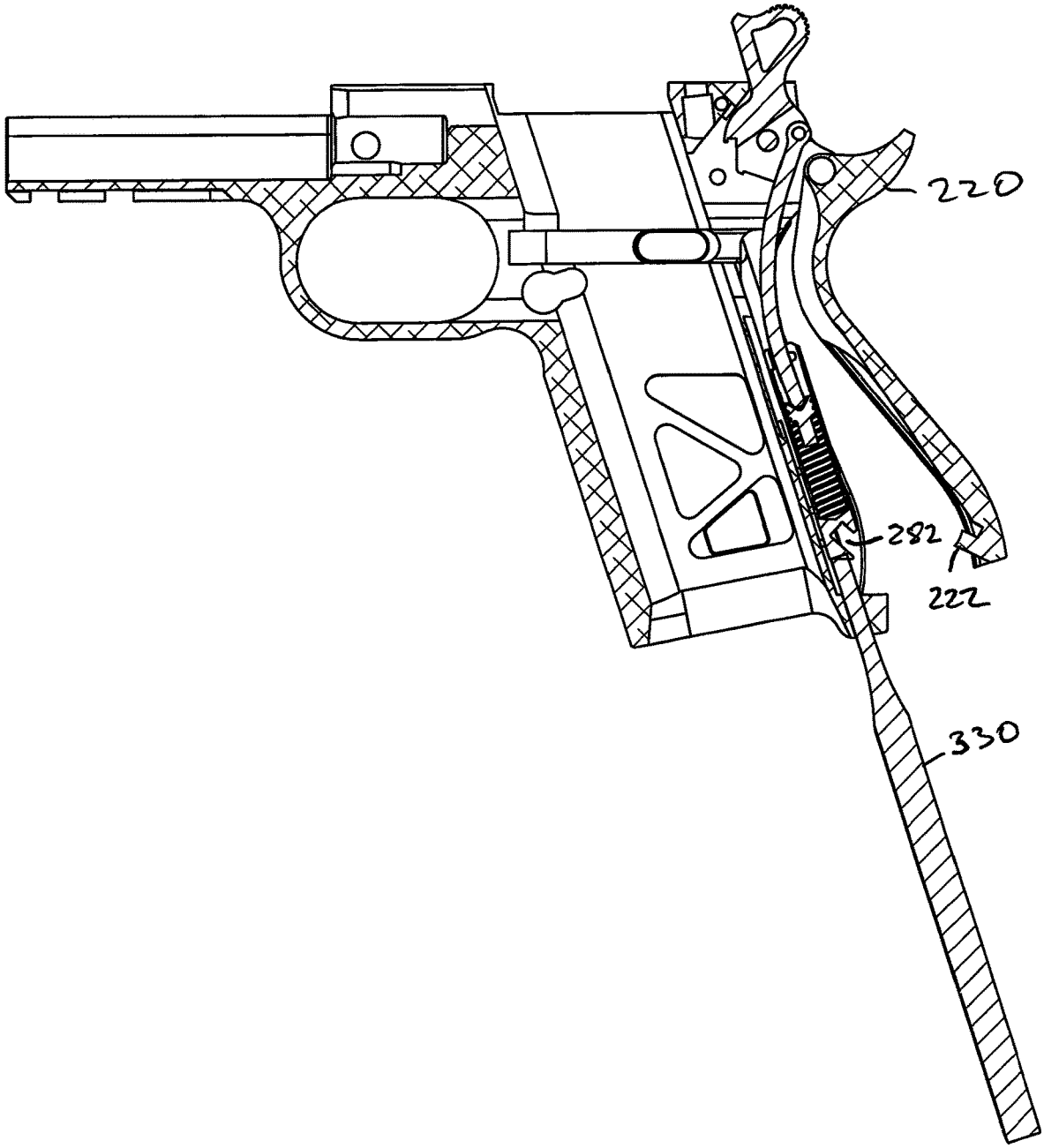
FIG. 18 depicts another cut away side view of a handgun according to some embodiments presently disclosed.
Figure 19:
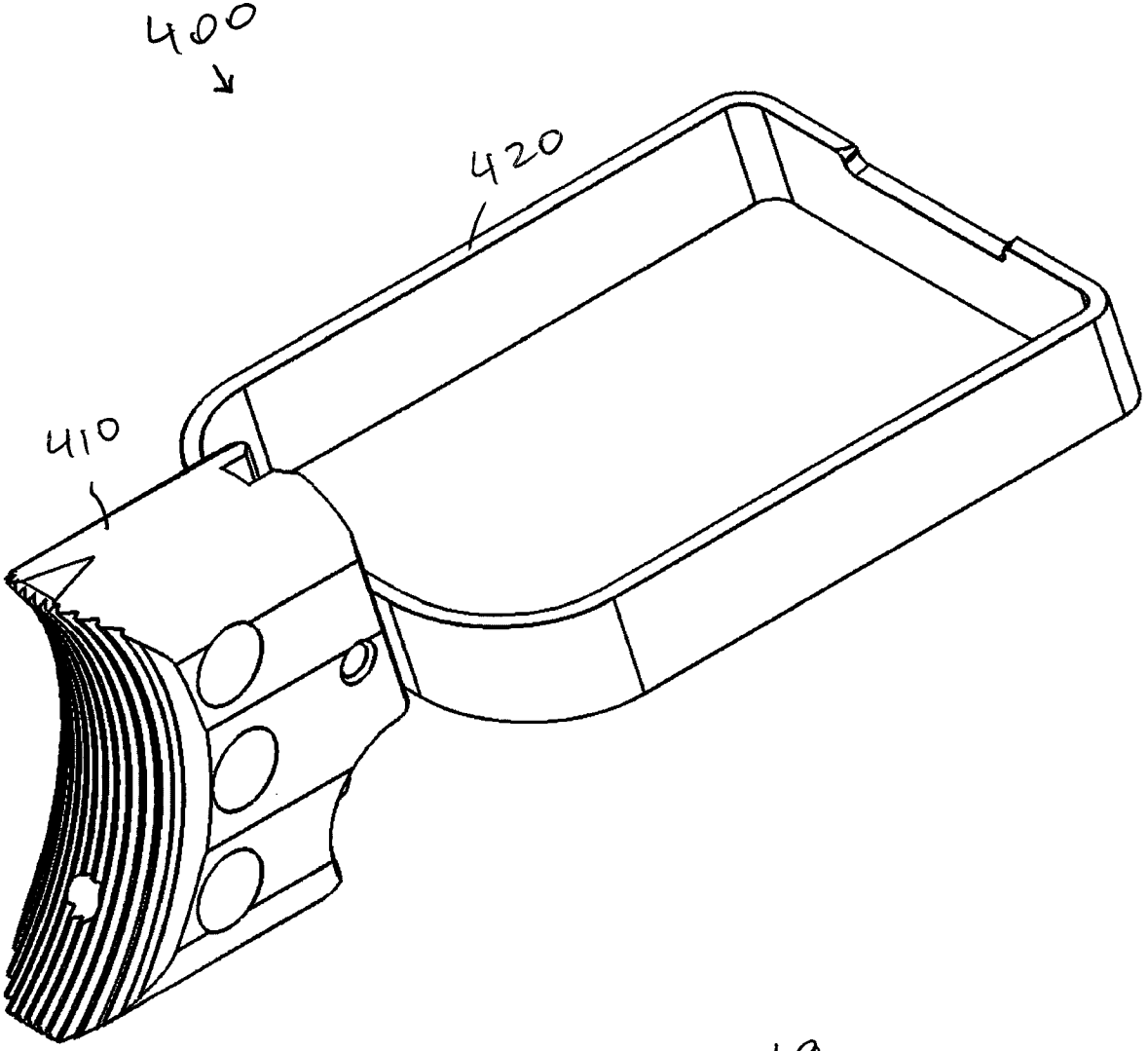
FIG. 19 depicts a perspective view of a trigger assembly according to some embodiments presently disclosed.
Figure 20:
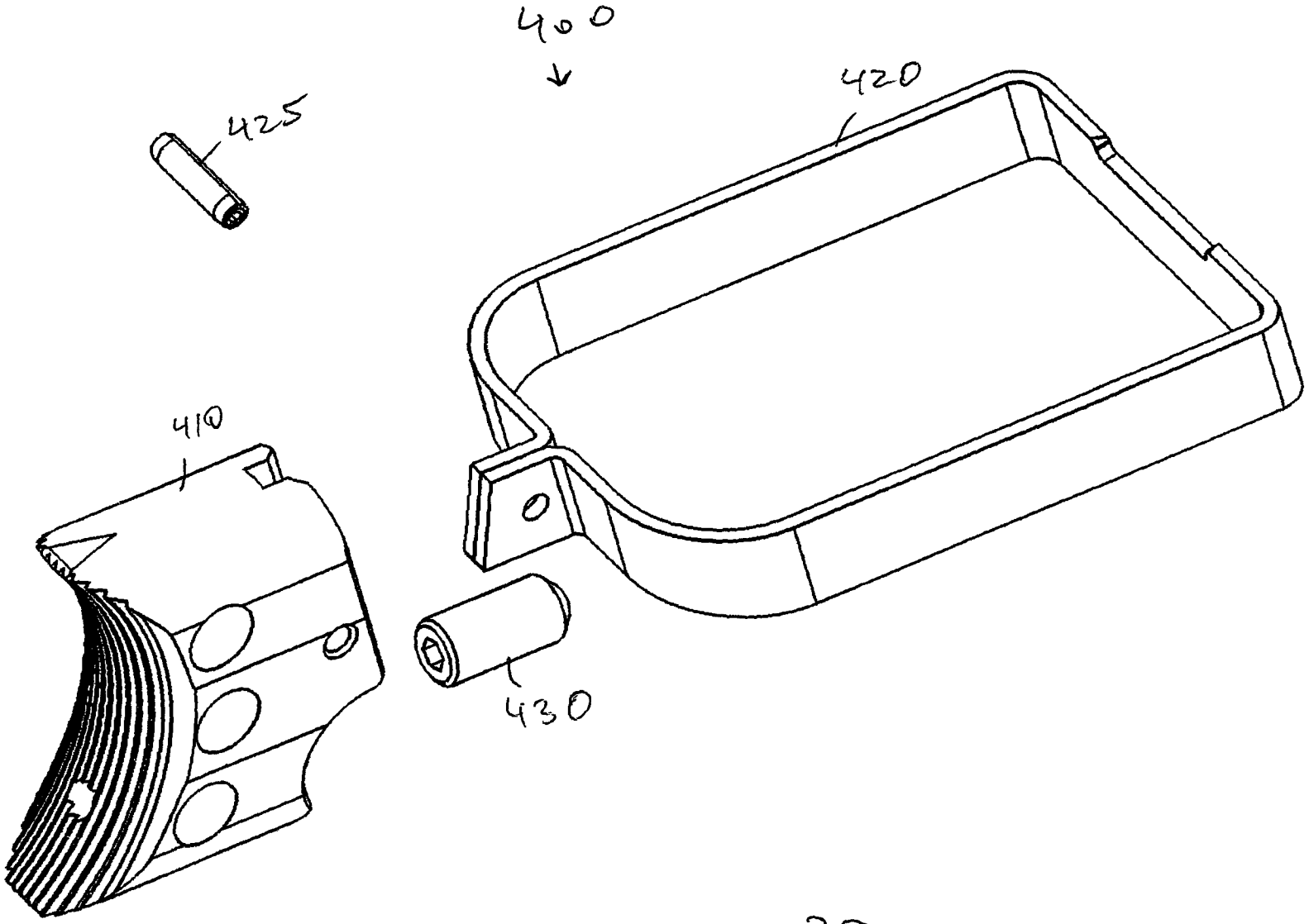
FIG. 20 depicts an exploded view of the trigger assembly shown in FIG. 19.
Figure 21:
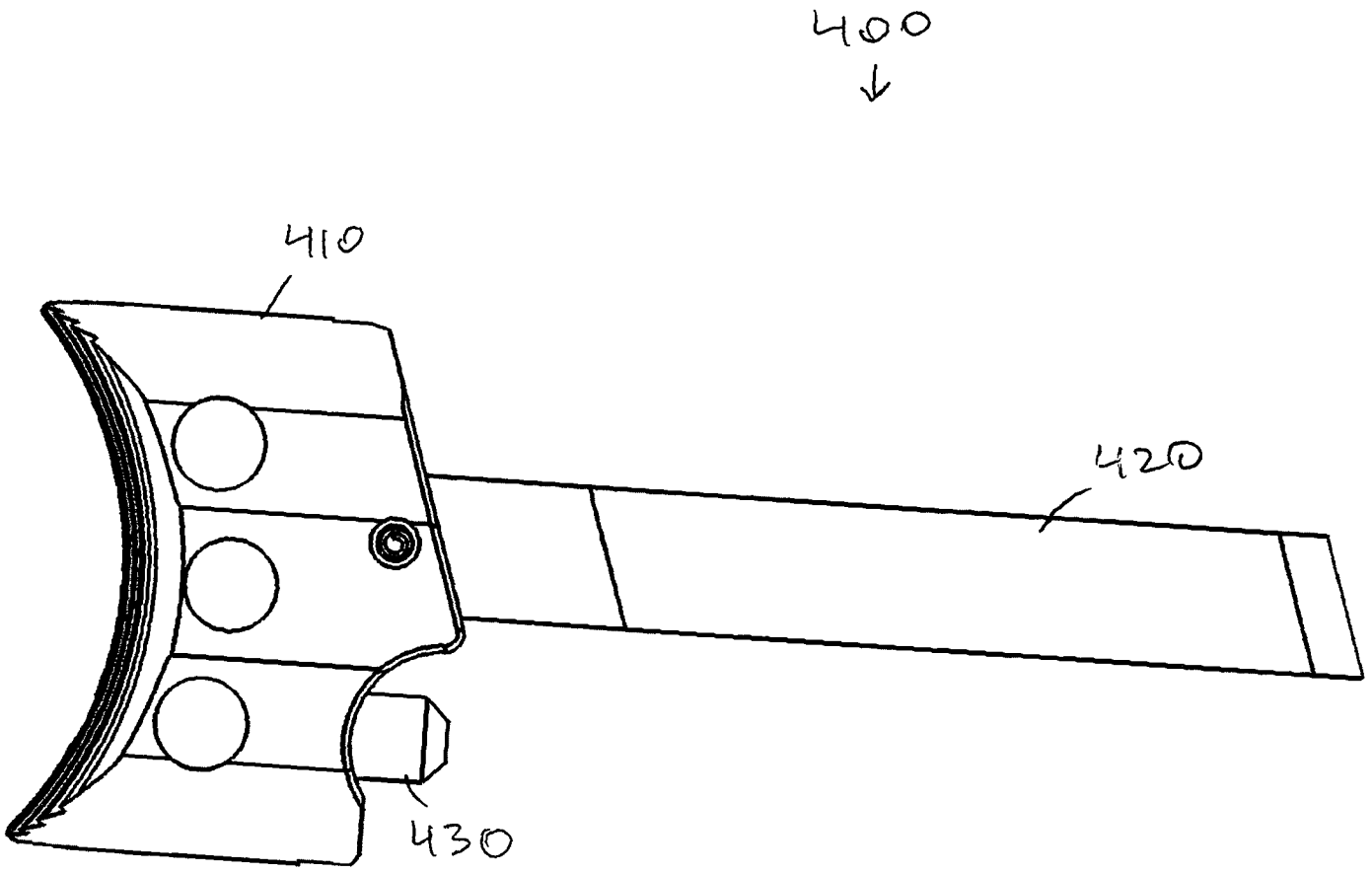
FIG. 21 depicts a side view of the trigger assembly shown in FIG. 19.
Figure 22:
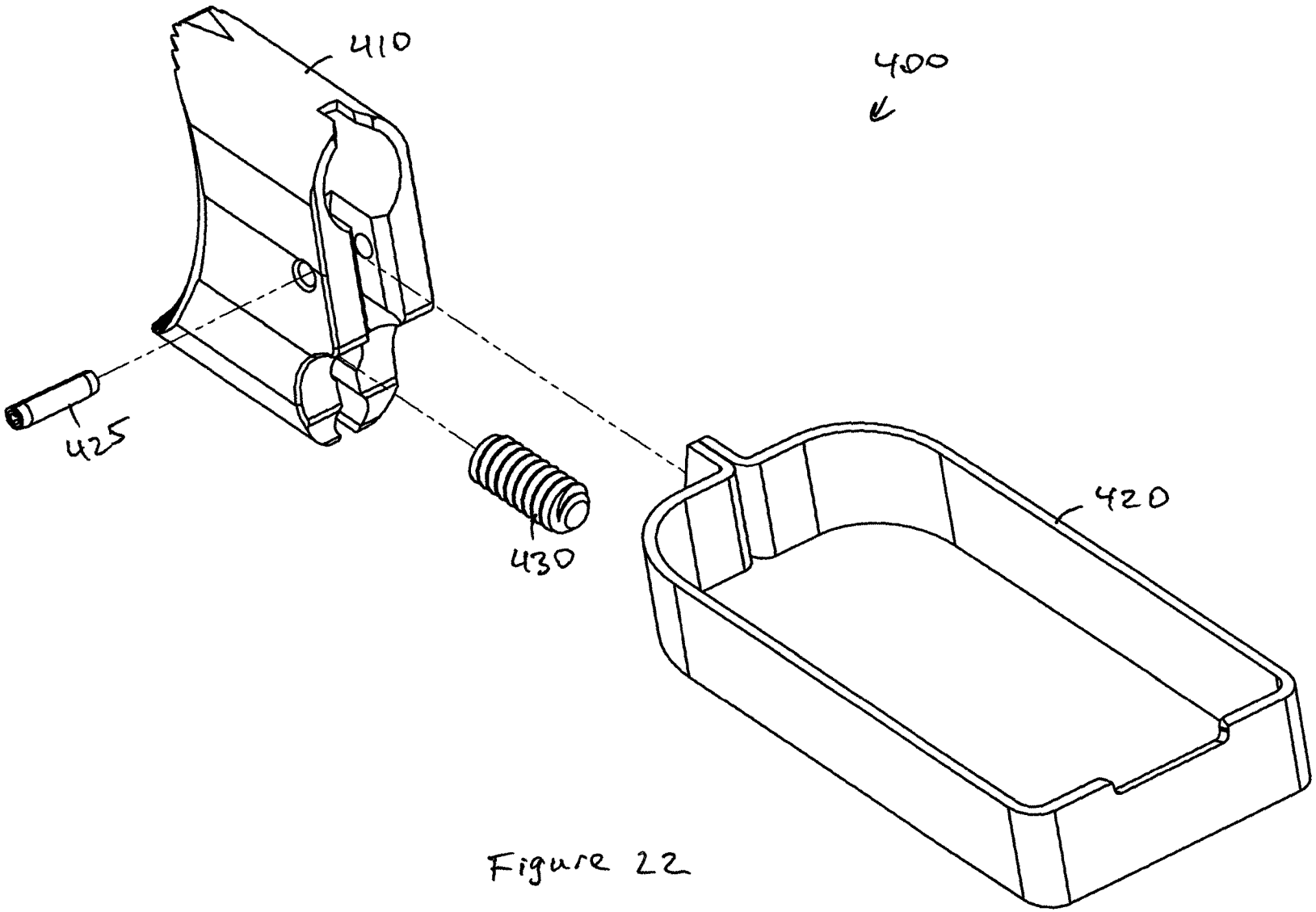
FIG. 22 depicts a rear, exploded view of the trigger assembly shown in FIG. 19.

According to some embodiments presently disclosed, the housing 280 is configured to move from a first (locking) position to a second (unlocking) position and back to the first (locked) position. According to some embodiments, the housing 280 is retained in the first (locking) position by the spring 275. According to some embodiments, at least a portion of the interlocking protrusion 222 is positioned in the interlocking opening 282 when the housing 280 is in the first (locking) position. According to some embodiments, moving the housing 280 to the second (unlocking) position releases the interlocking protrusion 222 from the interlocking opening 282. According to some embodiments, releasing the interlocking protrusion 222 from the interlocking opening 282 allows the removable back strap 220 to swing away from the handle 20 as shown in FIG. 18. According to some embodiments, the removal of the back strap 220 allows for an easier cleaning of the frame 10.

Figure 17:
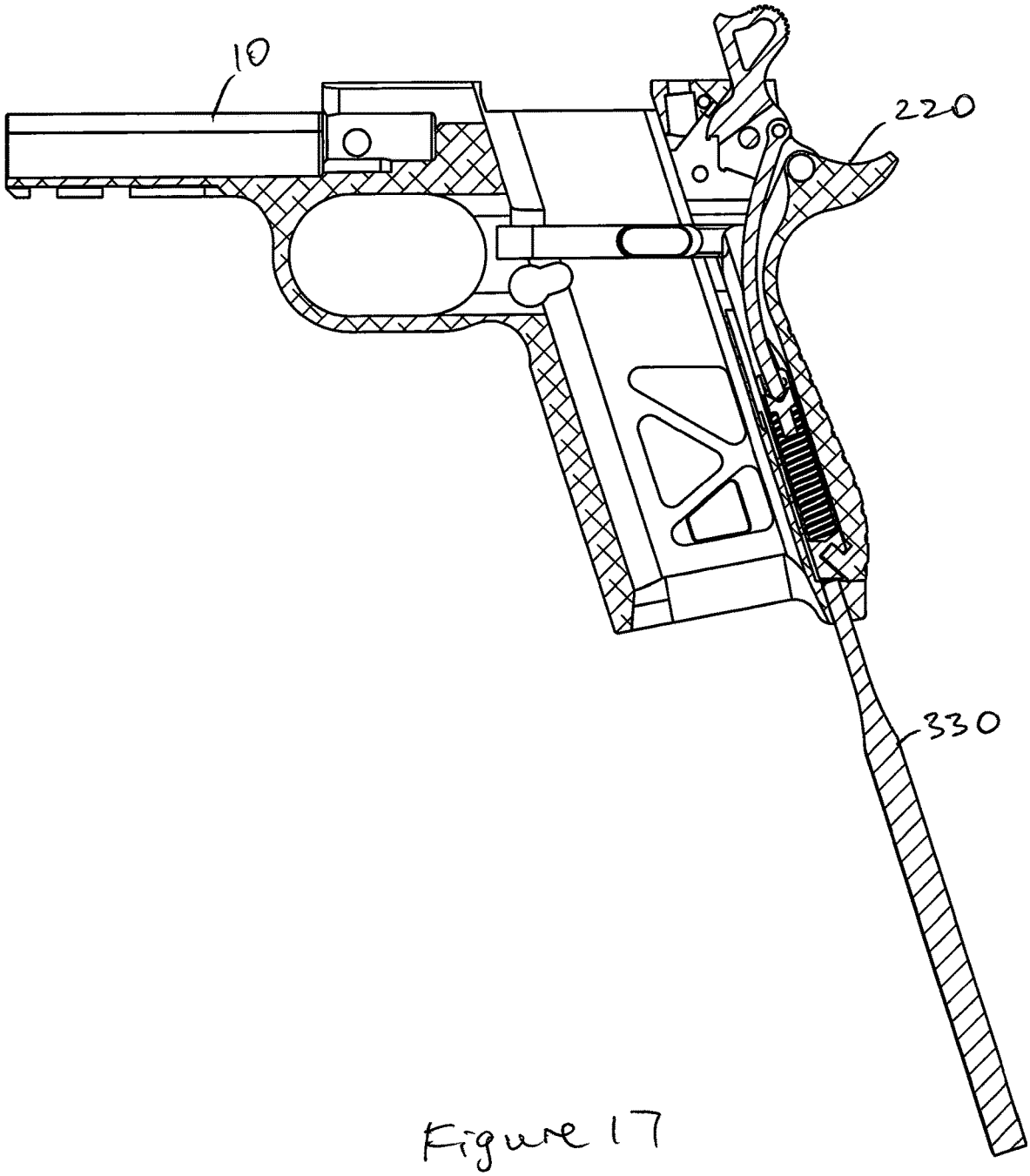
FIG. 17 depicts another cut away side view of a handgun according to some embodiments presently disclosed.

According to some embodiments, a tool 330 may be used to move the housing 280 to the second (unlocking) position. The tool 330 may be a punch tool. According to some embodiments presently disclosed, the tool 330 is used to push the housing 280 towards the hammer 51 causing the spring 275 to be compressed against the strut 260 and the interlocking protrusion 222 to be released from the interlocking opening 282 as shown in FIGS. 17-18.

According to some embodiments, the removable backstrap 220 may be different sizes to accommodate user's hands. According to some embodiments, the removable backstrap 220 may be replaced by a different size removable backstrap 220 to allow for a custom fit to a user's hand.

Figure 37:
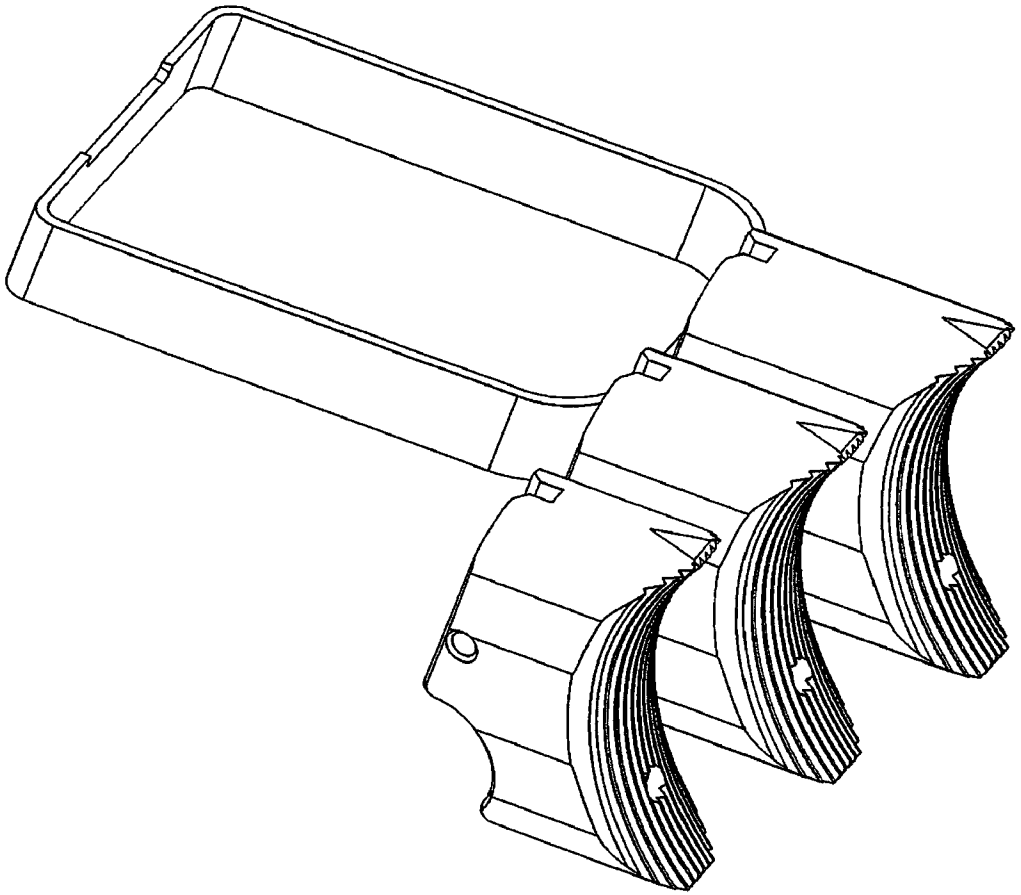
FIG. 37 depicts different size trigger pads according to some embodiments presently disclosed.

Referring to FIGS. 19-22, the handgun 5 comprises a modular trigger assembly 400 according to some embodiments presently disclosed. The modular trigger assembly 400 comprises a removable trigger pad 410 removably coupled with a trigger bow 420. According to some embodiments, a pin 425 may be used to couple the trigger pad 410 with the trigger bow 420. The pin 425 may be a spring pin. According to some embodiments, the trigger pad 410 may be manufactured in different sizes (as shown in FIG. 37) to allow a user to have a custom fit. The modular trigger assembly 400 may also comprise an over travel screw 430.

Figure 23:
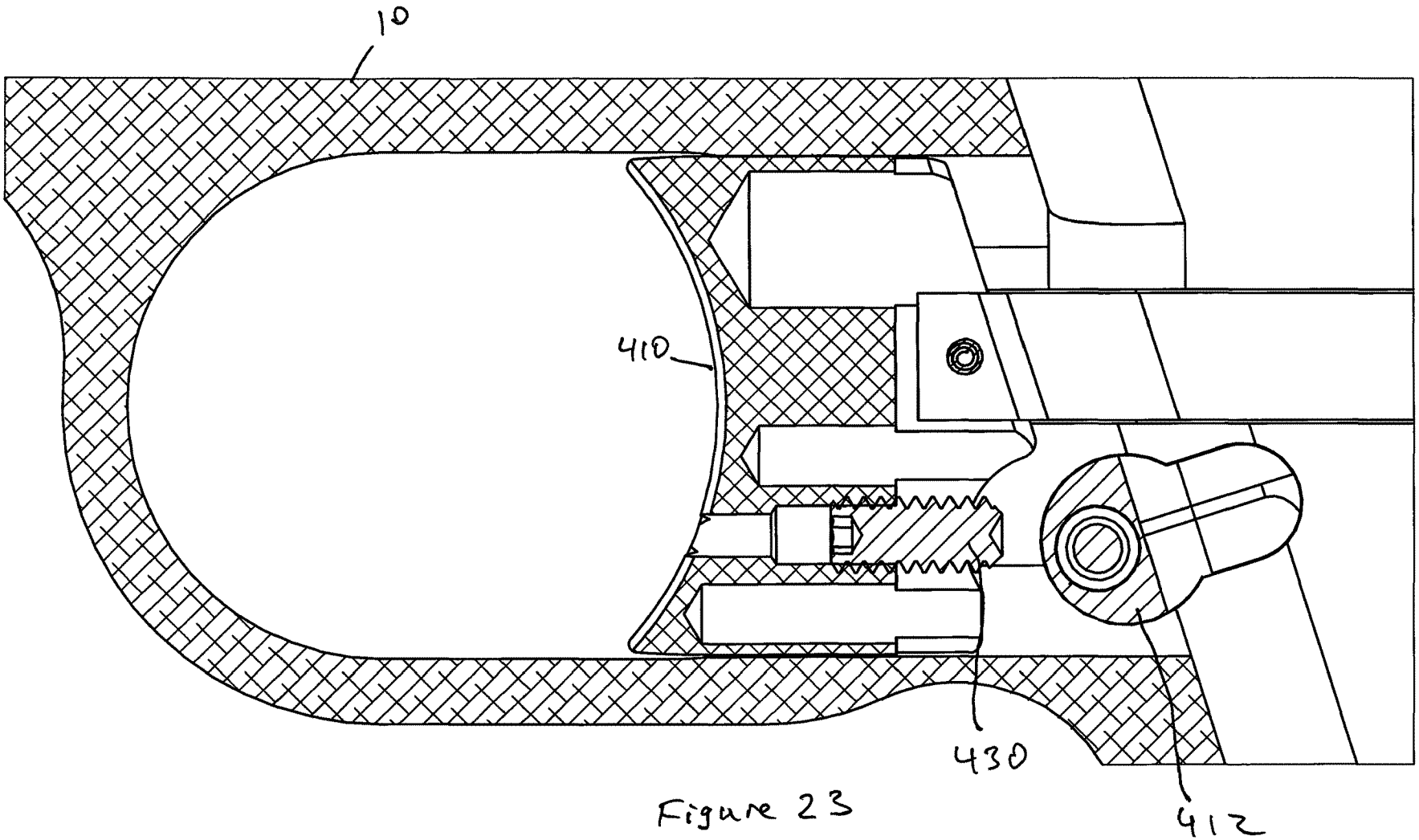
FIG. 23 depicts a cut away side view of a handgun according to some embodiments presently disclosed.
Figure 24:
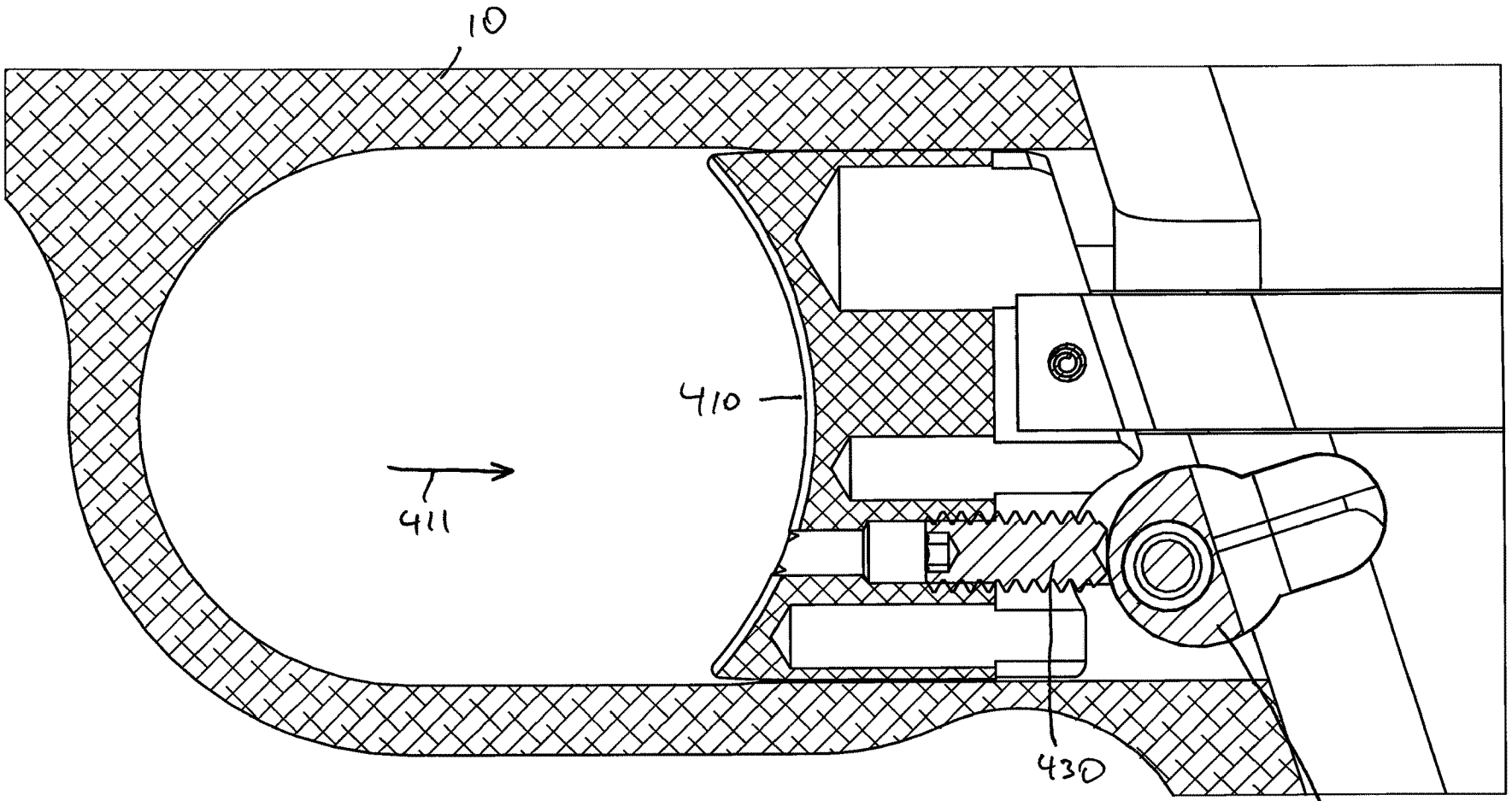
FIG. 24 depicts another cut away side view of a handgun according to some embodiments presently disclosed.

Referring to FIGS. 23-24, a partial view of the frame 10 is shown according to some embodiments presently disclosed. The trigger pad 410 configured to move from a first (safe) position (shown in FIG. 23) to a second (firing) position (shown in FIG. 24) and back to the first (safe) position. When the trigger pad 410 is in the second (firing) position (by being pushed in a direction 411 as shown in FIG. 24), a projectile is fired from the handgun 5. The over travel screw 430 may be used to prevent the trigger pad 410 from being pushed in the direction 411 after the projectile is fired from the handgun 5. The over travel screw 430 may abut the safety 412 to prevent the trigger pad 410 from being pushed in the direction 411 after the projectile is fired from the handgun 5

Figure 25:
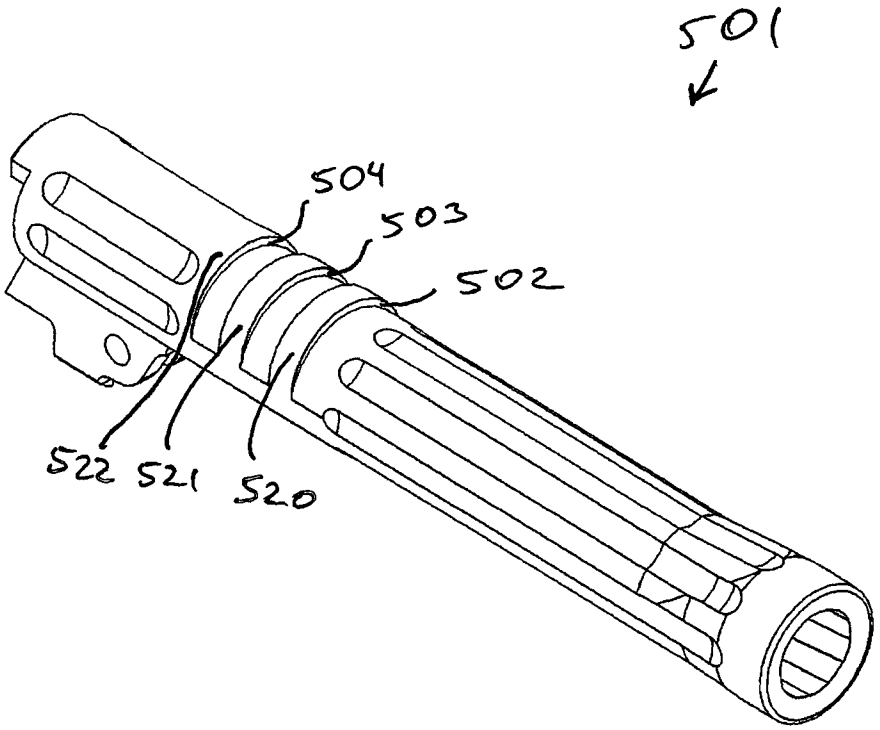
Figure 25 PRIOR ART
FIG. 25 depicts an M1911 barrel as known in the art.

Referring to FIG. 25, a barrel 501 as known in the art is shown. The barrel 501 comprises locking lugs 520, 521, 522 each comprising lock-up surfaces 502, 503, 504 that correspond to transverse locking grooves (not shown) on the inner surface of a slide of the M1911 handgun as known in the art.

As known in the art, it is challenging to manufacture the locking lugs 520, 521, 522 on the barrel 501 and the corresponding locking grooves (not shown) in the inner surface of a slide of the M1911 handgun as known in the art. Each of the locking lugs 520, 521, 522 is an off-center circular cut in the body of the barrel 501. Not only is the front-to-back location of the slots between the locking lugs critical, the radius of the offset, the depth the cut creates in the barrel and the width of the trough cut also matter. A mistake of even ten-thousands of an inch can prevent the barrel 501 from operating properly with the slide (not shown) and may even destroy the slide during firing of the M1911 handgun known in the art.

Figure 26:
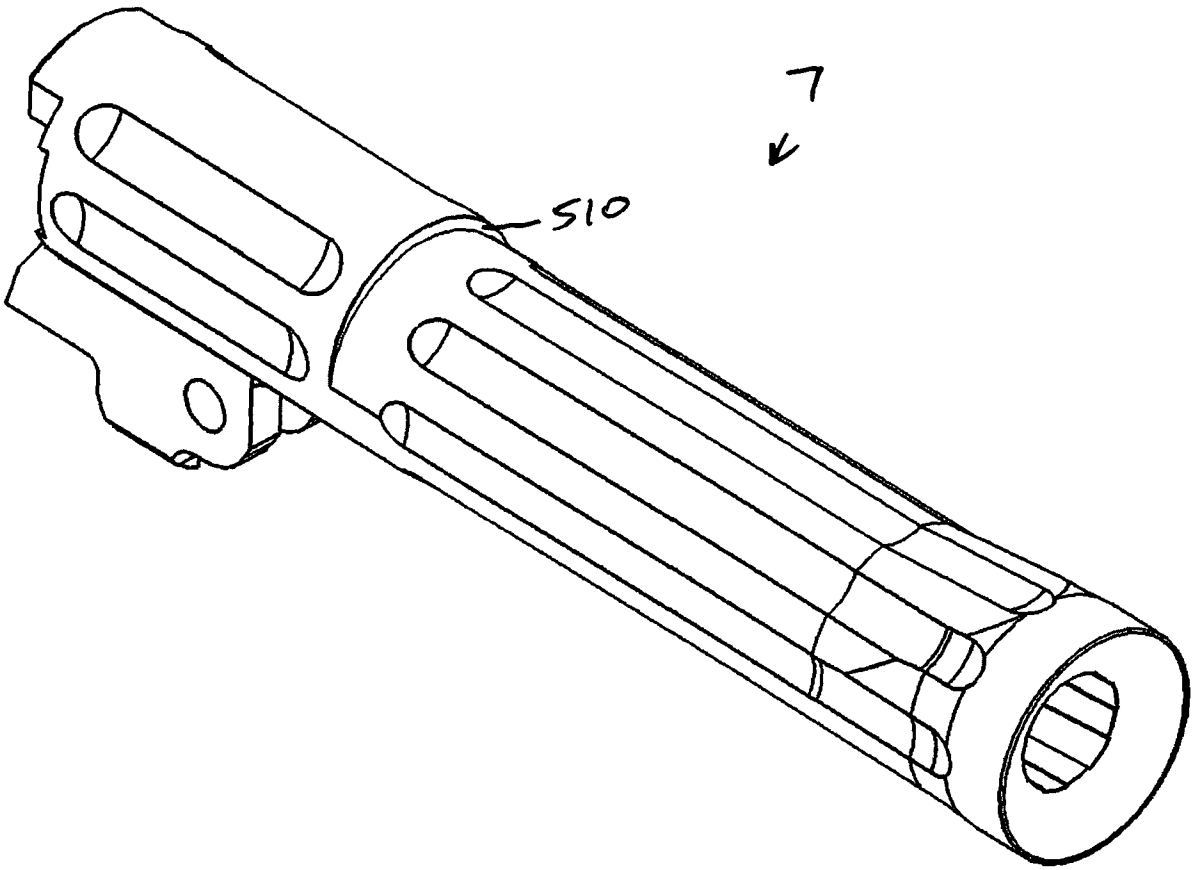
FIG. 26 depicts a barrel according to some embodiments presently disclosed.
Figure 27:
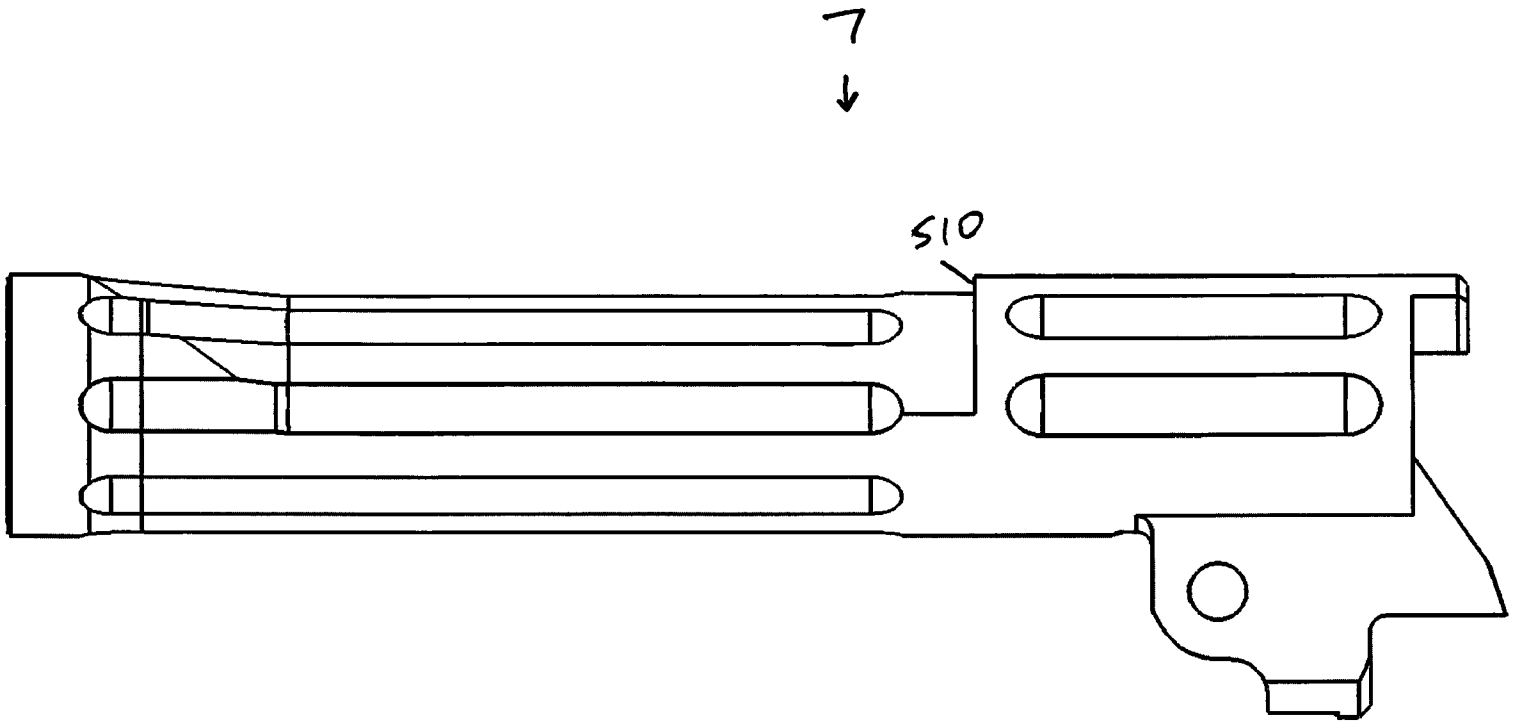
FIG. 27 depicts a side view of the barrel shown in FIG. 26.
Figure 28:
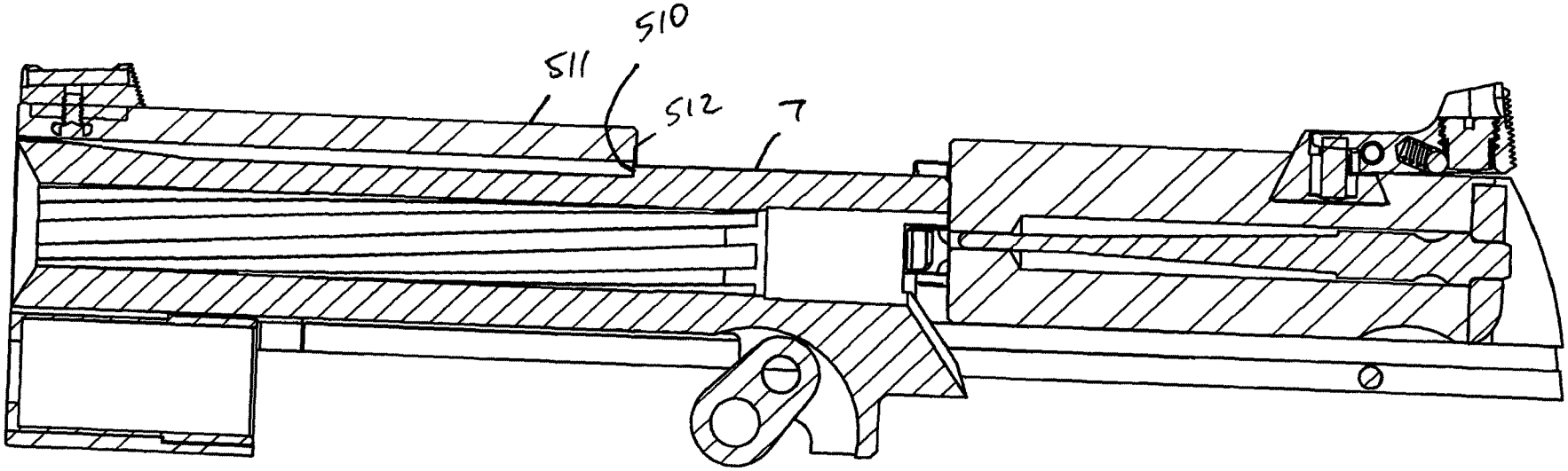
FIG. 28 depicts a cut away side view of a handgun according to some embodiments presently disclosed.
Figure 29:
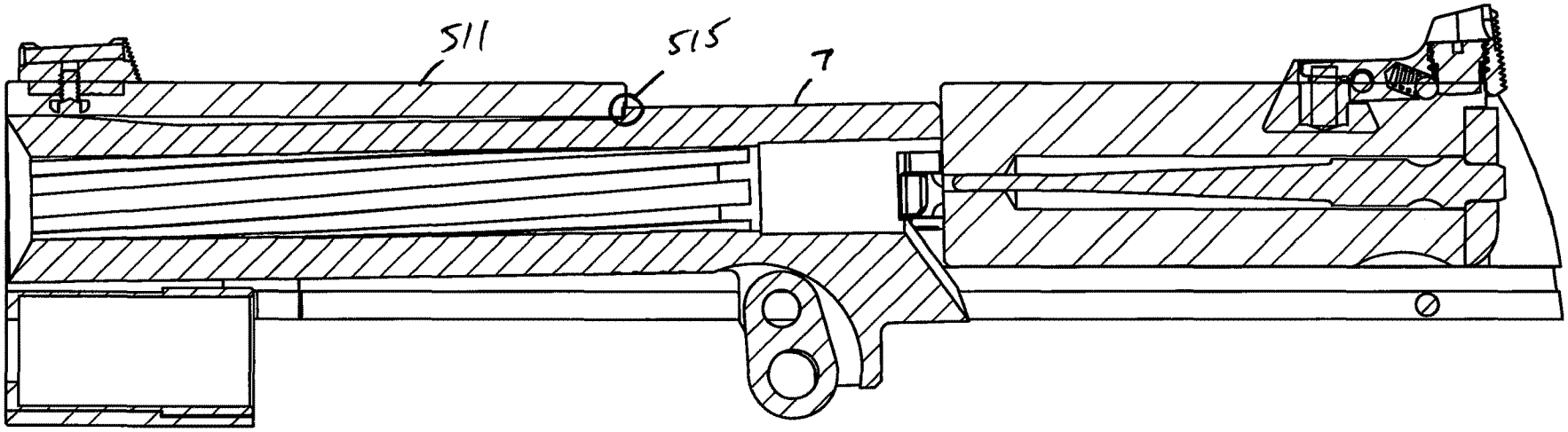
FIG. 29 depicts another cut away side view of a handgun according to some embodiments presently disclosed.

Referring to FIGS. 26-27, the barrel 7 of the handgun 5 comprises only one lock-up surface 510 according to some embodiments presently disclosed. Referring to FIGS. 28-29 depicting a cut away view of the slide 511 on top of the barrel 7, the barrel lock-up surface 510 interacts 515 with a slide lock-up surface 512.

Having only one lock-up surface 510 simplifies manufacturing of the barrel 7 and having only one corresponding lock-up surface 512 simplifies manufacturing of the slide 511.

Figure 30:
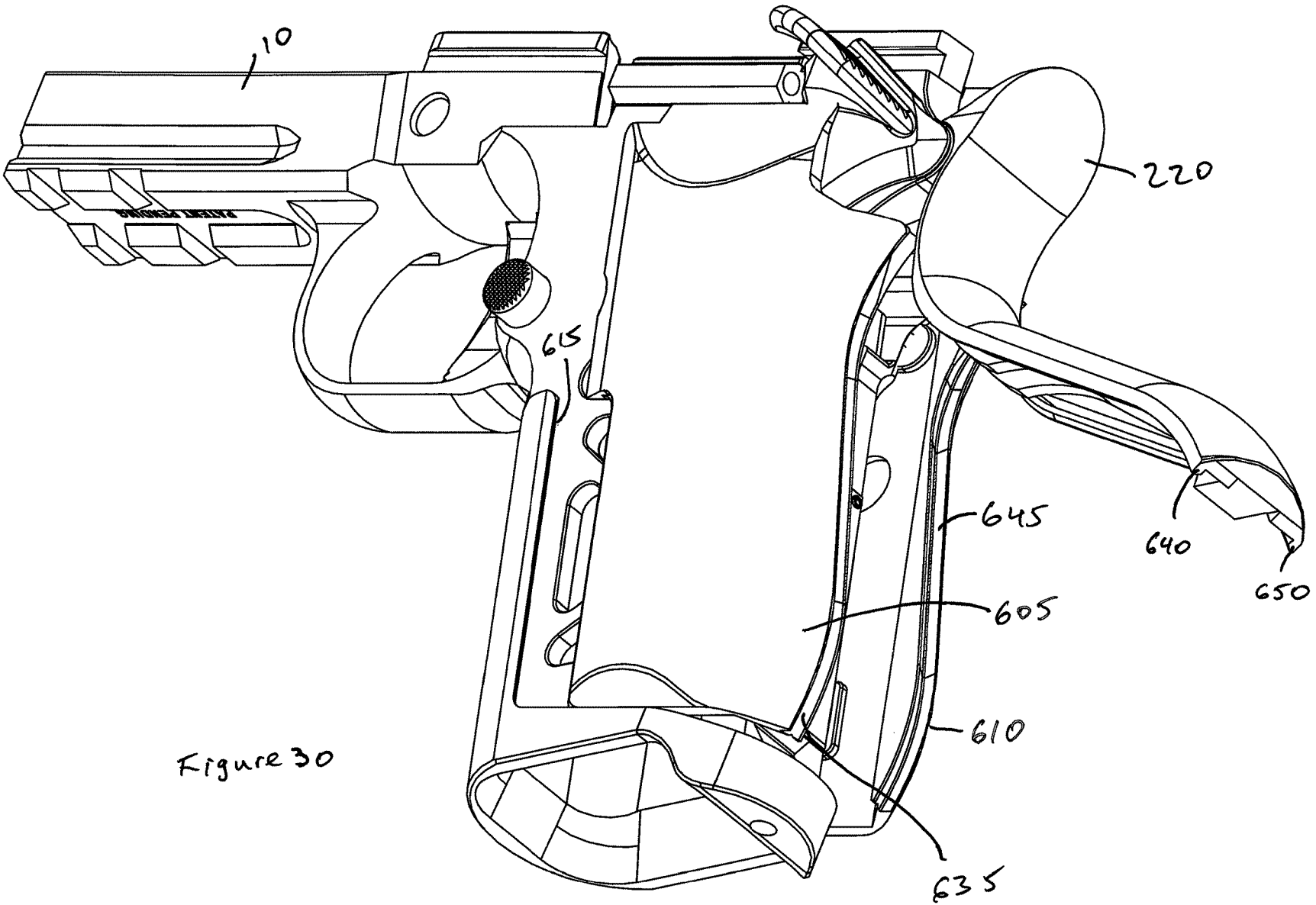
FIG. 30 depicts a side view of a handgun according to some embodiments presently disclosed.

Referring to FIGS. 12 and 30, the handgun 5 comprises a left side grip 605 and a right side grip 610 according to some embodiments presently disclosed. The side grips 605 and 610 are removably coupled with the frame 10. Contrary to the prior art, presently disclosed side grips 605 and 610 are removably coupled with the frame 10 without using any screws or bolts.

Figure 31:
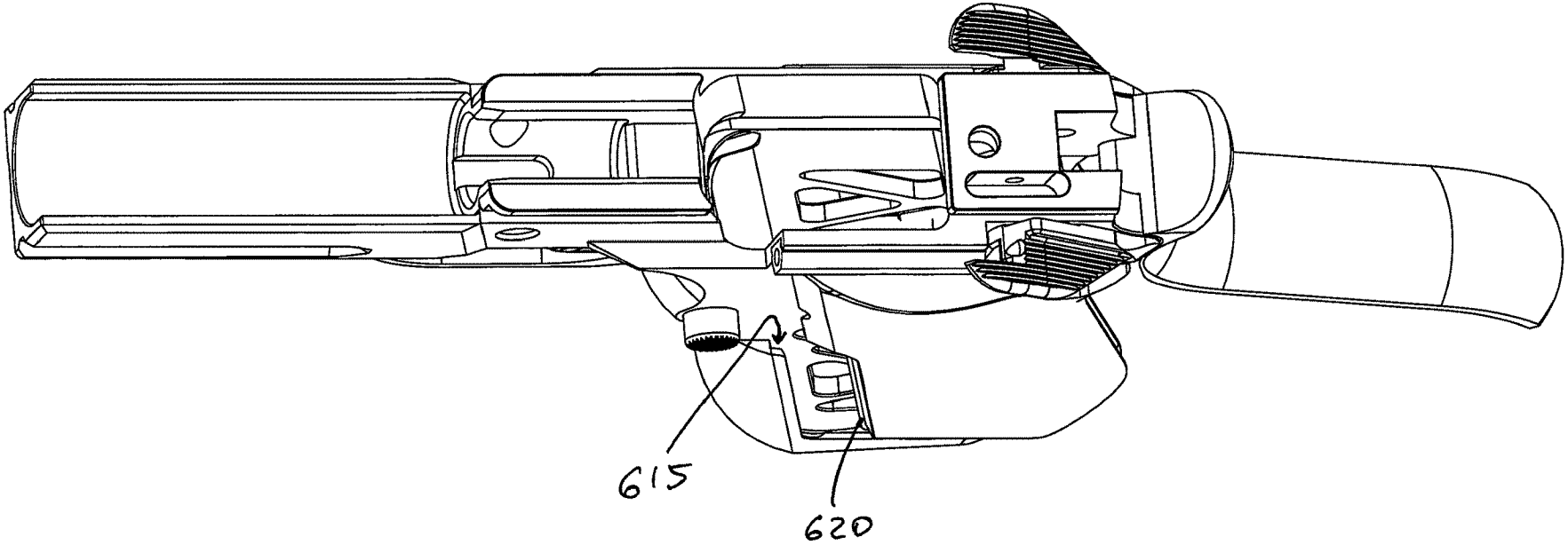
FIG. 31 depicts a top, left side view of a handgun according to some embodiments presently disclosed.

According to some embodiments presently disclosed, the handle 20 of the frame 10 comprises a left side channel 615 (shown in FIGS. 30-32) configured (i.e. adapted) to receive and hold a front portion 620 of the left side grip 605. According to some embodiments presently disclosed, the handle 20 of the frame 10 comprises a right side channel 625 (shown in FIG. 32) configured (i.e. adapted) to receive and hold a front portion 630 of the right side grip 610.

Figure 32:
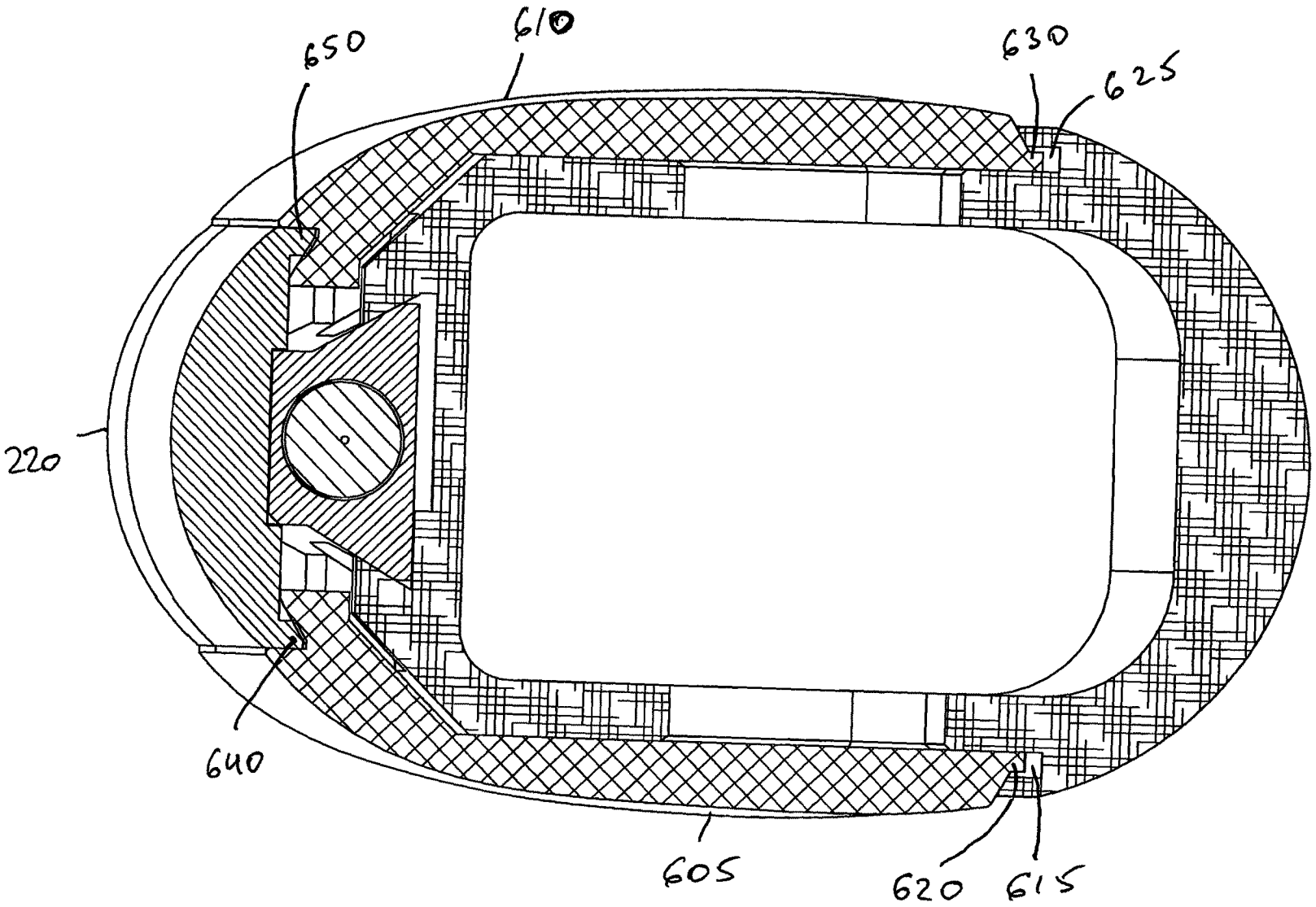
FIG. 32 depicts a bottom, cut away view of a handle according to some embodiments presently disclosed.
Figure 33:
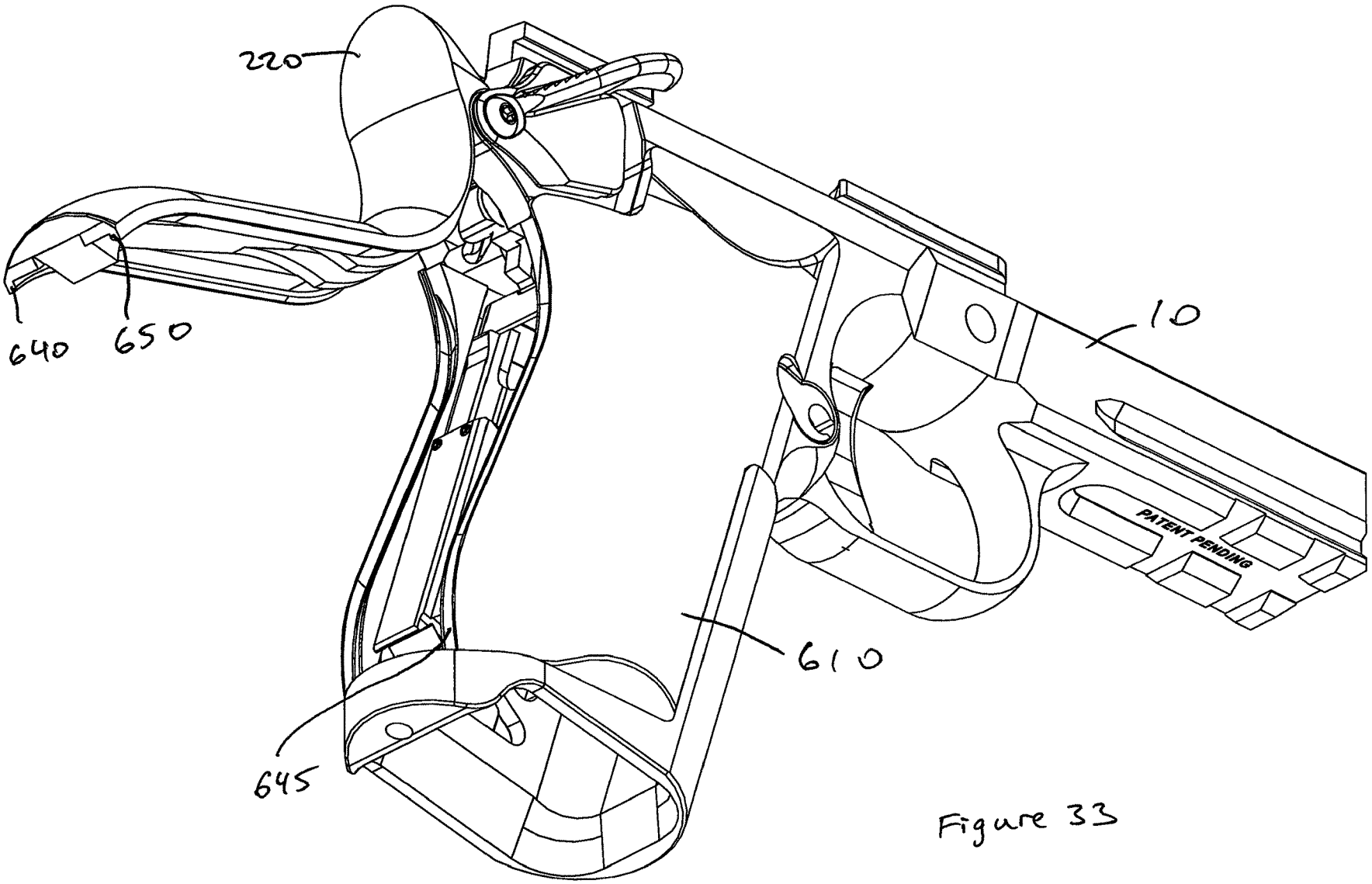
FIG. 33 depicts a side view of a handgun according to some embodiments presently disclosed.

According to some embodiments presently disclosed, the left side grip 605 comprises a rear edge channel 635 (shown in FIG. 30) configured (i.e. adapted) to receive and hold a rear portion 640 of the backstrap member 220 (shown in FIGS. 30 and 32). According to some embodiments presently disclosed, the right side grip 610 comprises a rear edge channel 645 (shown in FIGS. 30 and 33) configured (i.e. adapted) to receive and hold a rear portion 650 of the backstrap member 220 (shown in FIGS. 30 and 32-33).

As shown in FIG. 32 depicting the bottom, cut away view of the handle 20, the left side grip 605 is removably coupled with the frame 10 by being sandwiched between the left side channel 615 and the backstrap member 220. Removing the backstrap member 220, allows a user to remove the left side grip 605 from the left side channel 615.

As shown in FIG. 32 depicting the bottom, cut away view of the handle 20, the right side grip 610 is removably coupled with the frame 10 by being sandwiched between the right side channel 625 and the backstrap member 220.

Removing the backstrap member 220, allows the user to remove the right side grip 610 from the right side channel 625.

The side grips 605, 610 can be manufactured in different thicknesses (i.e. sizes) to accommodate different size hands for more comfortable gripping of the handle 20. The backstrap member 220 can be manufactured in different thicknesses (i.e. sizes) to accommodate different size hands for more comfortable gripping of the handle 20.

Figure 34:
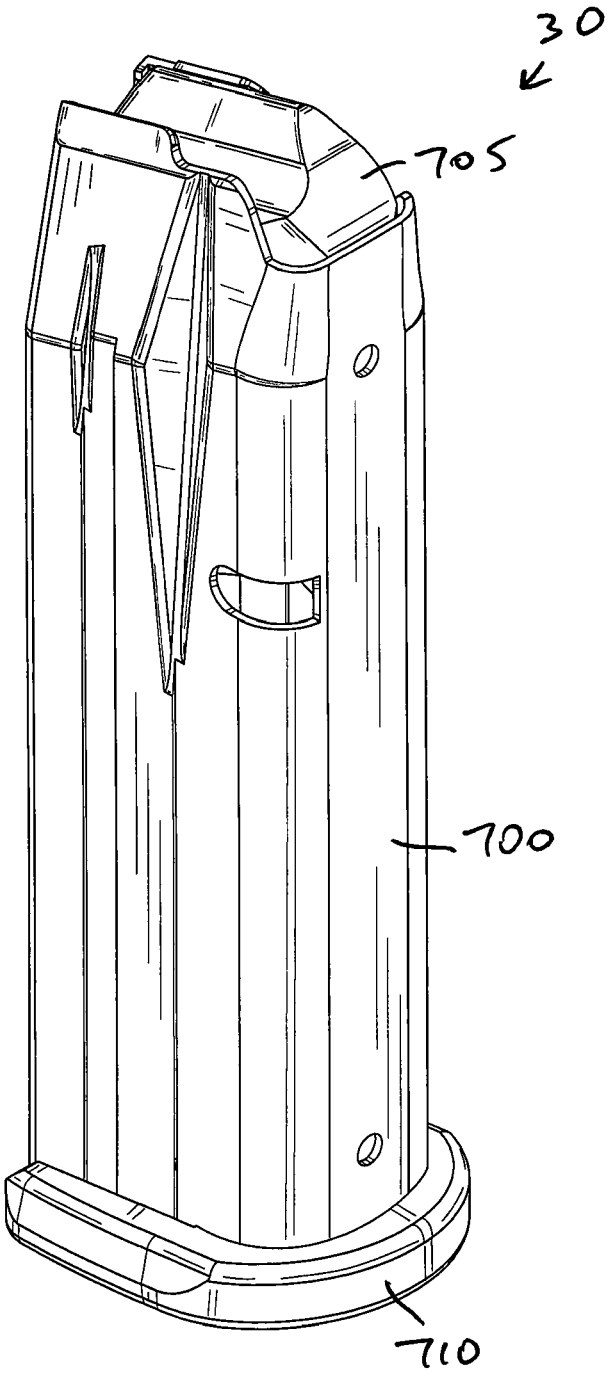
FIG. 34 depicts a front, perspective view of a magazine according to some embodiments presently disclosed.
Figure 35:
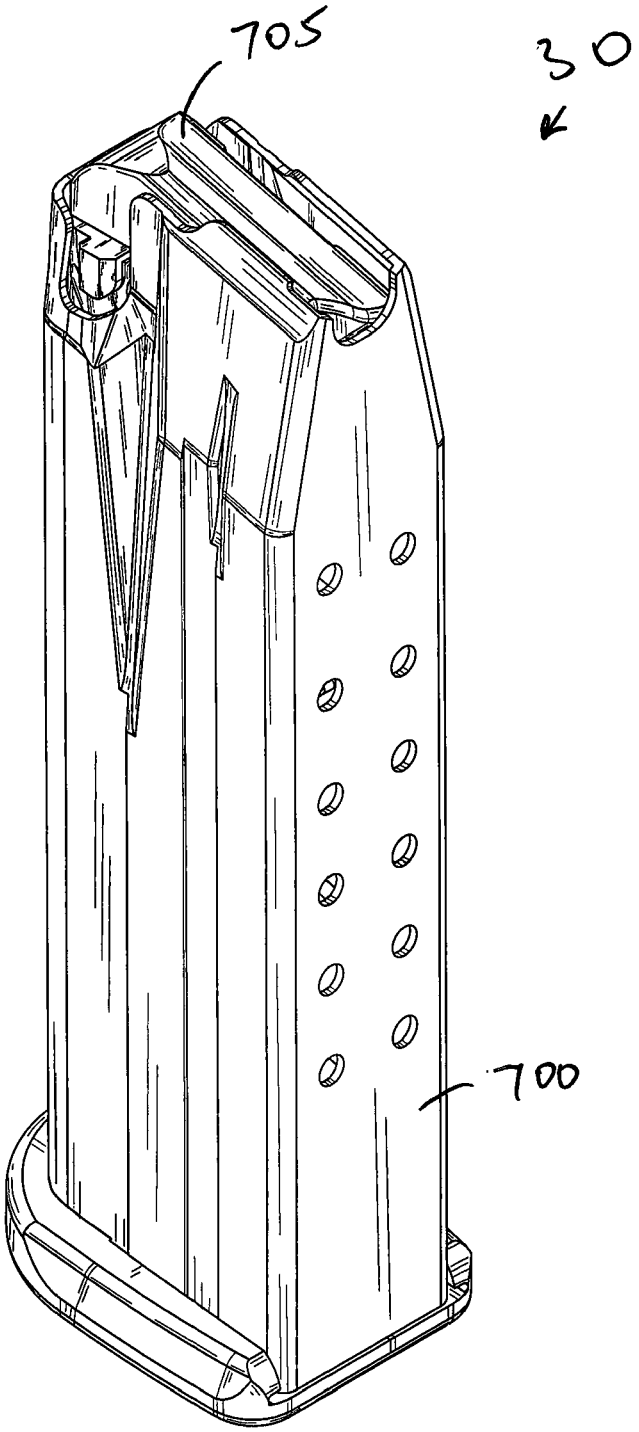
FIG. 35 depicts a rear, perspective view of a magazine according to some embodiments presently disclosed.

Referring to FIGS. 34-35, the magazine 30 is shown according to some embodiments presently disclosed. The magazine 30 comprises a body 700, magazine fallower 705, a magazine base plate (not shown), and a magazine spring (not shown) disposed inside the body 700. The body may comprise steel, metal and/or polymer material. The magazine 30 may also comprise a modular basepad 710. According to some embodiments, the basepad 710 is configured to support one or more of the user's fingers. According to some embodiments, the basepad 710 may be manufactured different heights and/or thickness. According to some embodiments, the magazine 30 may accommodate 15 or more bullets. The magazine 30 is a double stack magazine. The double stack magazines are thicker and accommodate more bullets than a single stack magazine.

According to some embodiments presently disclosed, the frame 10 may be machined from a single piece of metal. The metal may be Aluminum. The metal may be 7075-T6 Aluminum.

While several illustrative embodiments of the invention have been shown and described, numerous variations and alternative embodiments will occur to those skilled in the art. Such variations and alternative embodiments are contemplated, and can be made without departing from the scope of the invention as defined in the appended claims.

As used in this specification and the appended claims, the singular forms "a," "an," and "the" include plural referents unless the content clearly dictates otherwise. The term "plurality" includes two or more referents unless the content clearly dictates otherwise. Unless defined otherwise, all technical and scientific terms used herein have the same meaning as commonly understood by one of ordinary skill in the art to which the disclosure pertains.

What is claimed is:

1. An improved M1911 metal frame comprising:

a dovetail opening; and a plunger tube comprising a dovetail shape, wherein the plunger tube is positioned within the dovetail opening of the improved M1911 metal frame.

2. The improved M1911 metal frame of claim 1, wherein the plunger tube is slidably coupled with the improved M1911 metal frame.

3. The improved M1911 metal frame of claim 1 further comprising a safety assembly.

4. The improved M1911 metal frame of claim 1 further comprises a trigger assembly, wherein the trigger assembly comprises a removable trigger pad.

5. The improved M1911 metal frame of claim 1 further comprising a handle, wherein the handle comprises a left side channel adapted to receive and hold a front portion of a left side grip.

6. The improved M1911 metal frame of claim 5, wherein the handle comprises a right side channel adapted to receive and hold a front portion of a right side grip.

7. The improved M1911 metal frame of claim 6, further comprising a backstrap, wherein the left side grip is sandwiched between the left side channel and the backstrap and the right side grip is sandwiched between the right side channel and the backstrap.

8. The improved M1911 metal frame of claim 5, wherein the handle comprises a cavity adapted to receive and hold a housing.

9. The improved M1911 metal frame of claim 8, wherein the housing comprises a cavity sized to accommodate a main spring, a main spring cap, and a portion of a strut.

10. The improved M1911 metal frame of claim 8, wherein the housing comprises an interlocking opening adapted to accommodate an interlocking protrusion associated with a backstrap.

* * * * *